US006988456B1

(12) United States Patent
Schooler

(10) Patent No.: US 6,988,456 B1
(45) Date of Patent: Jan. 24, 2006

(54) PERSONAL WATERCRAFT

(76) Inventor: Timothy E. Schooler, 6786 County Rd. 50, Carver, MN (US) 55315

( * ) Notice: Subject to any disclaimer, the term of this patent is extended or adjusted under 35 U.S.C. 154(b) by 0 days.

(21) Appl. No.: 10/765,007

(22) Filed: Jan. 26, 2004

Related U.S. Application Data

(63) Continuation of application No. 10/386,904, filed on Mar. 12, 2003, now abandoned.
(60) Provisional application No. 60/363,899, filed on Mar. 12, 2002.

(51) Int. Cl.
*B63B 1/00* (2006.01)

(52) U.S. Cl. ..... 114/61.16; 114/344; 280/414.2
(58) Field of Classification Search ..... 114/61.1, 114/61.15, 61.16, 61.18, 344, 352; 280/414.2
See application file for complete search history.

(56) References Cited

U.S. PATENT DOCUMENTS

| | | | | |
|---|---|---|---|---|
| 3,193,851 | A | | 7/1965 | Fiebelkern |
| 3,316,873 | A | * | 5/1967 | Dismukes ..... 114/344 |
| 3,601,077 | A | * | 8/1971 | Valenza ..... 114/61.15 |
| 3,763,511 | A | | 10/1973 | Sisil |
| 3,839,979 | A | | 10/1974 | Wassell |
| 3,902,741 | A | | 9/1975 | Rudder |
| 4,300,252 | A | | 11/1981 | Montooth |
| 4,367,689 | A | | 1/1983 | Lukehart et al. |
| 4,386,441 | A | | 6/1983 | Lundholm |
| 4,768,454 | A | | 9/1988 | Selken |
| 4,829,926 | A | | 5/1989 | Voelkel |
| 5,038,697 | A | | 8/1991 | Farrier |
| 5,373,799 | A | | 12/1994 | Green |
| 5,399,111 | A | | 3/1995 | Kobayashi et al. |
| 5,547,209 | A | | 8/1996 | Vanderlinde |
| 5,582,126 | A | | 12/1996 | Rypinski |
| 5,617,810 | A | | 4/1997 | Sauerwein |
| 5,870,966 | A | | 2/1999 | Christian |
| 5,964,178 | A | | 10/1999 | Gonda |
| 5,975,005 | A | | 11/1999 | Yoshioka |

OTHER PUBLICATIONS

Bass Pro Shops Outdoors Online Shopping. 2002.
Cabela's—Float Tubes. 2002.
Cabela's—Pontoons. 2002.
Cabela's–5'×10' Aluminum Pontoon Boat. 2002.
Champions Quality.
Porta–Bote.
Ranger Boats.
Northern Exposure—Mitey Toon Pontoon.
Northern Exposure—Mitey Toon Electric.

(Continued)

*Primary Examiner*—Lars A. Olson
(74) *Attorney, Agent, or Firm*—Sherrill Law Offices, PLLC

(57) ABSTRACT

A personal watercraft including a hull and at least two pontoons repositionably attached to the hull with at least one pontoon attached proximate the starboard side and at least one pontoon attached proximate the port side. The pontoons are laterally and longitudinally repositionable as between a storage position in which the pontoons are generally longitudinally aligned relative to the hull and have a minimized lateral distance between the pontoons, and a flotation position in which the pontoons are shifted aft relative to the longitudinally aligned storage position and have a maximized lateral distance between the pontoons.

Also, a personal watercraft having one or both of (i) a pair of laterally spaced hitch attachments secured to the hull proximate the bow of the hull, and/or (ii) a pair of laterally spaced hitch attachments secured to the hull proximate the stern of the hull 20. This aspect of the personal watercraft permits the personal watercraft to be used with various accessories such as a towing attachment, a wheeled attachment, a transom, an interconnecting linkage and a supplemental decking attachment.

33 Claims, 24 Drawing Sheets

OTHER PUBLICATIONS

Fisherman's 510 Compact Pontoon Boat.
Search and Rescue 510.
510 Extended Pontoon Boat.
Fisherman's Compact Pontoon Boats.
Sportsmans Plus Multipurpose Utility Trailer.
Bass Baby.
E–Z Roller Launching Wheels.
Wheel a Weigh Wheels.
BassTender 11.3.
BassTender 10.6.
BassTender 10.2.
BassTender 9.4.
Cruz.
Seitech Products, Dolly, Configuration 10.
Seitech Products, Dolly, Configuration 1.
Seitech Products, Dolly, Configuration 6.
Idea Development Co., Wheel A Weigh Small Boat Dolly.
V–Dock, Quick Latch Tow Bar.

* cited by examiner

PERSONAL WATERCRAFT

This application is a continuation of U.S. patent application Ser. No. 10/386,904 filed Mar. 12, 2003, now abandoned, which application claims priority to U.S. provisional patent application Ser. No. 60/363,899 filed Mar. 12, 2002.

FIELD OF THE INVENTION

This invention relates to personal watercraft.

BACKGROUND

A wide variety of portable personal watercraft have been developed ranging from simple miniaturized versions of boats and pontoons, to inflatable boats and pontoons, as well as collapsible and foldable boats and pontoons such as those described in U.S. Pat. Nos. 5,975,005, 5,964,178, 5,870,966, 4,829,926, and 4,386,441.

Miniaturized versions of boats and pontoons tend to be portable but are generally unreliable, unstable in the water and lack fishability. Inflatable boats and inflatable pontoons provide portability, but are susceptible to puncturing, difficult to inflate and deflate, are often unstable and lack fishability. Collapsible and foldable boats avoid the problems inherent with inflatable boats, but are themselves typically difficult to convert back-and-forth between the folded deployable conditions, and are often unstable in the water.

Accordingly, a substantial need exists for a sturdy portable personal watercraft which is stable in the water and capable of being quickly and easily transformed back and forth between a compact transportable condition and an expanded deployment condition.

SUMMARY OF THE INVENTION

The invention is directed to personal watercraft and combinations of personal watercraft and various accessories.

A first aspect of the invention is a personal watercraft comprising a hull and a plurality of pontoons. The hull has a bow, a stern, a starboard side, a port side, a longitudinally extending overall length and a laterally extending beam. A first embodiment of the first aspect of the invention includes at least two pontoons repositionably attached to the hull with at least one pontoon attached proximate the starboard side and at least one pontoon attached proximate the port side. The pontoons are laterally and longitudinally repositionable between a storage position in which the pontoons are generally longitudinally aligned relative to the hull and have a minimized lateral distance between the pontoons, and a flotation position in which the pontoons are shifted aft relative to the longitudinally aligned storage position and have a maximized lateral distance between the pontoons.

A second embodiment of the first aspect of the invention includes at least four pontoons repositionably attached to the hull with at least one pontoon positioned off a starboard bow of the hull, at least one pontoon positioned off a starboard quarter of the hull, at least one pontoon positioned off a port bow of the hull, and at least one pontoon positioned off a port quarter of the hull. The pontoons are laterally and longitudinally repositionable as between a storage position having a minimized lateral and longitudinal distance between the pontoons to facilitate transportation and storage, and a flotation position having a maximized lateral and longitudinal distance between the pontoons to provide improved flotation stability relative to the storage position.

A second aspect of the invention is a personal watercraft with a hull and a pair of laterally spaced hitch attachments secured to the hull proximate the bow.

A third aspect of the invention is a personal watercraft with a hull and a pair of laterally spaced hitch attachments secured to the hull proximate the stern.

A fourth aspect of the invention is a combination of a personal watercraft of the second or third aspect of the invention with an accessory selected from a towing attachment, a transom attachment, a wheeled attachment, an interconnect linkage and a supplemental decking attachment.

An embodiment of the towing attachment has (i) a pair of elements proximate a proximal longitudinal end of the towing attachment configured and arranged for cooperatively releasably engaging the pair of hitch attachments secured to the bull proximate the bow and (ii) a hitch attachment proximate a distal longitudinal end of the towing attachment.

An embodiment of the transom attachment has (i) a pair of elements proximate a proximal longitudinal end of the transom attachment configured and arranged for cooperatively releasably engaging the pair of hitch attachments secured to the hull proximate the stern, and (ii) a laterally extending beam proximate a distal longitudinal end of the transom attachment configured and arranged for supporting a boat motor in an operable position.

An embodiment of the wheeled attachment has (i) at least one element configured and arranged for cooperatively releasably engaging a hitch attachment secured to the hull proximate the stern, and (ii) at least one wheel configured and arranged on the wheeled attachment such that the wheel transversely extends below the bottom of the hull when the element on the wheeled attachment is engaged with at least one of the hitch attachments secured to the hull proximate the stern.

An embodiment of the interconnect linkage has (i) a first element proximate a first longitudinal end of the interconnect linkage configured and arranged for cooperatively releasably engaging a hitch attachment secured to the hull proximate the stern, and (ii) a second element attachment proximate a second longitudinal end of the interconnect linkage configured and arranged for cooperatively releasably engaging a hitch attachment secured to the hull proximate the stern, (iii) whereby a first personal watercraft can be interconnected stern-to-stern with a second personal watercraft.

An embodiment of the supplemental decking attachment has (i) a pair of hitch attachments proximate a first longitudinal end of the supplemental decking attachment configured and arranged for cooperatively releasably engaging the pair of hitch attachments secured to the hull proximate the stern, and (ii) a deck providing at least 5 $ft^2$, preferably at least 9 $ft^2$, of a planar upper surface.

DETAILED DESCRIPTION OF A PREFERRED EMBODIMENT

Definitions

As utilized herein, including the claims, the phrase "maximum longitudinal length" means the length at the longest point.

As utilized herein, including the claims, the phrase "maximum lateral width" means the width at the widest point.

As utilized herein, including the claims, the phrase "maximum transverse height" means the height at the highest point.

As utilized herein, including the claims, the phrase "operable position" when used to described the position of a boat motor, means that the propeller is positioned below the waterline.

As utilized herein, including the claims, the phrase "releasably retaining" means that release from a retained position or condition can be achieved by hand without the use of a tool.

Nomenclature

10 Personal Watercraft
10*x* Maximum Longitudinal Length of the Personal Watercraft
10*y* Maximum Lateral Width of the Personal Watercraft
10*z* Maximum Transverse Height of the Personal Watercraft
11 Console
12 Socket for Pedestal Seat on the Personal Watercraft
20 Hull on the Personal Watercraft
20*x* Longitudinal Overall Length of the Hull
20*y* Lateral Beam of the Hull
20*z* Transverse Height of the Hull
20 Bow
22 Stern
23 Starboard Side
24 Port Side
30 Bottom
40 Deck on the Personal Watercraft
41 Upper Surface of Deck
50*s* Starboard Pontoon
50*p* Port Pontoon
50*sb* Starboard Bow Pontoon
50*sq* Starboard Quarter Pontoon
50*pb* Port Bow Pontoon
50*pq* Port Quarter Pontoon
60 Connector Assembly
70 Connector Link
70*s* Starboard Side Connector Links
70*p* Port Side Connector Links
71 Distal End of Connector Link
72 Proximal End of Connector Link
73 Connector Bolt
80 Connector Plate
81 Locking Pin
88 Arc-Shaped Channel in Connector Plate
89 Radial Locking Notches in Connector Plate
91 Hitch Attachments Proximate the Bow
92 Hitch Attachments Proximate the Stern
110 Towing Attachment
111 Frame of Towing Attachment
111*d* Distal End of Frame
111*p* Proximal End of Frame
112 Hitch Attachment at Distal End of Frame
120 Wheeled Attachment
121 Frame of Wheeled Attachment
122 Wheels
130 Transom Attachment
130*d* Distal End of Transom Attachment

130*p* Proximal End of Transom Attachment
131 Beam
140 Interconnect Linkage
150 Supplemental Decking Attachment
150*a* Front of Supplemental Decking Attachment
151 Hull on the Supplemental Decking Attachment
152 Deck on the Supplemental Decking Attachment
153 Socket for Pedestal Seat on Supplemental Decking Attachment
A Seat
B Trolling Motor
C Foot Pedal for Trolling Motor
x Longitudinal Axis
y Lateral Axis
z Transverse Axis Construction The invention is a personal watercraft 10 and combinations of a personal watercraft 10 with various accessories.

Figure 1:
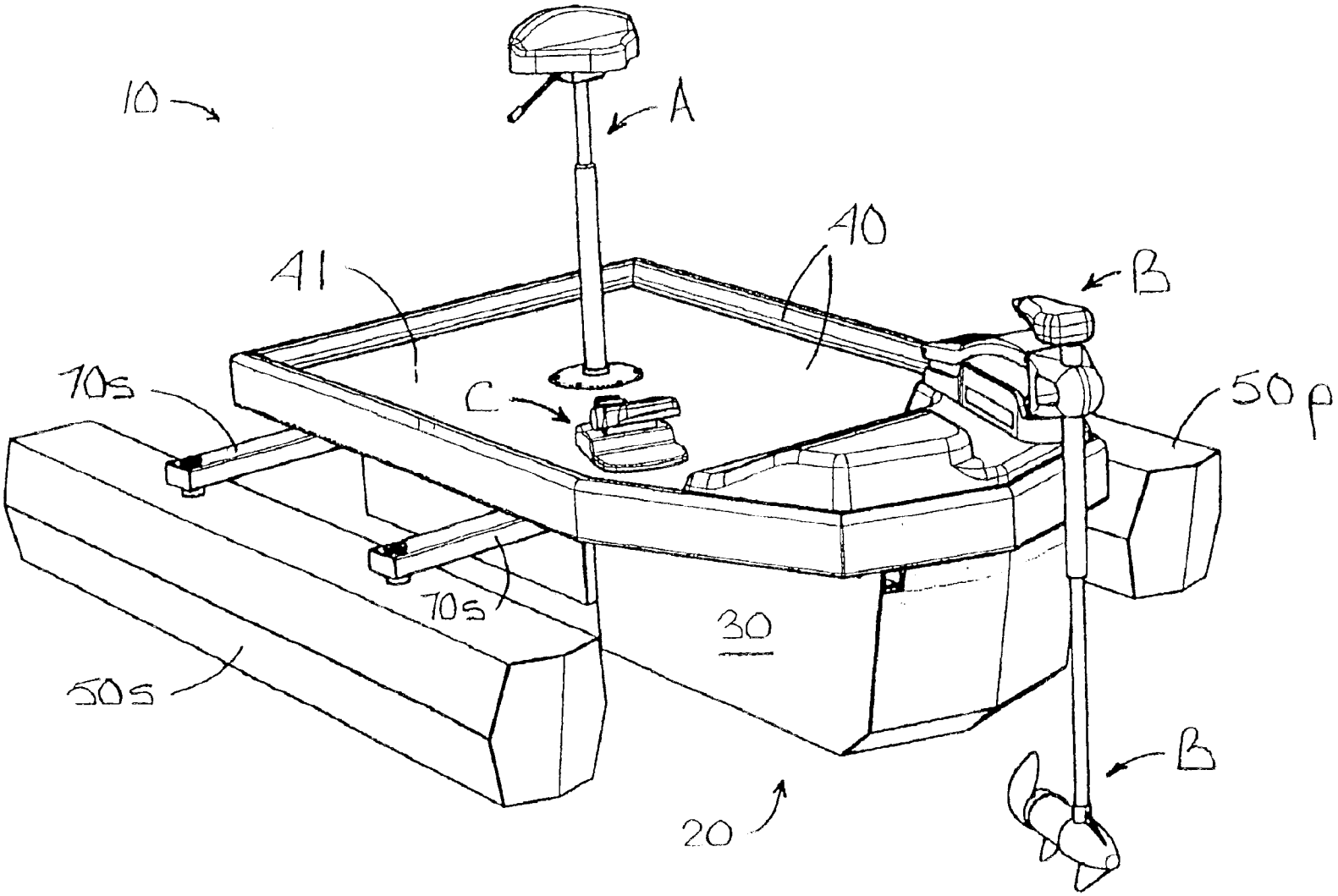
FIG. 1 is an upper perspective view from the starboard bow of one embodiment of the personal watercraft aspect of the invention equipped with a trolling motor placed in a trolling position and a pedestal seat, with the pontoons placed in the flotation position.
Figure 7:
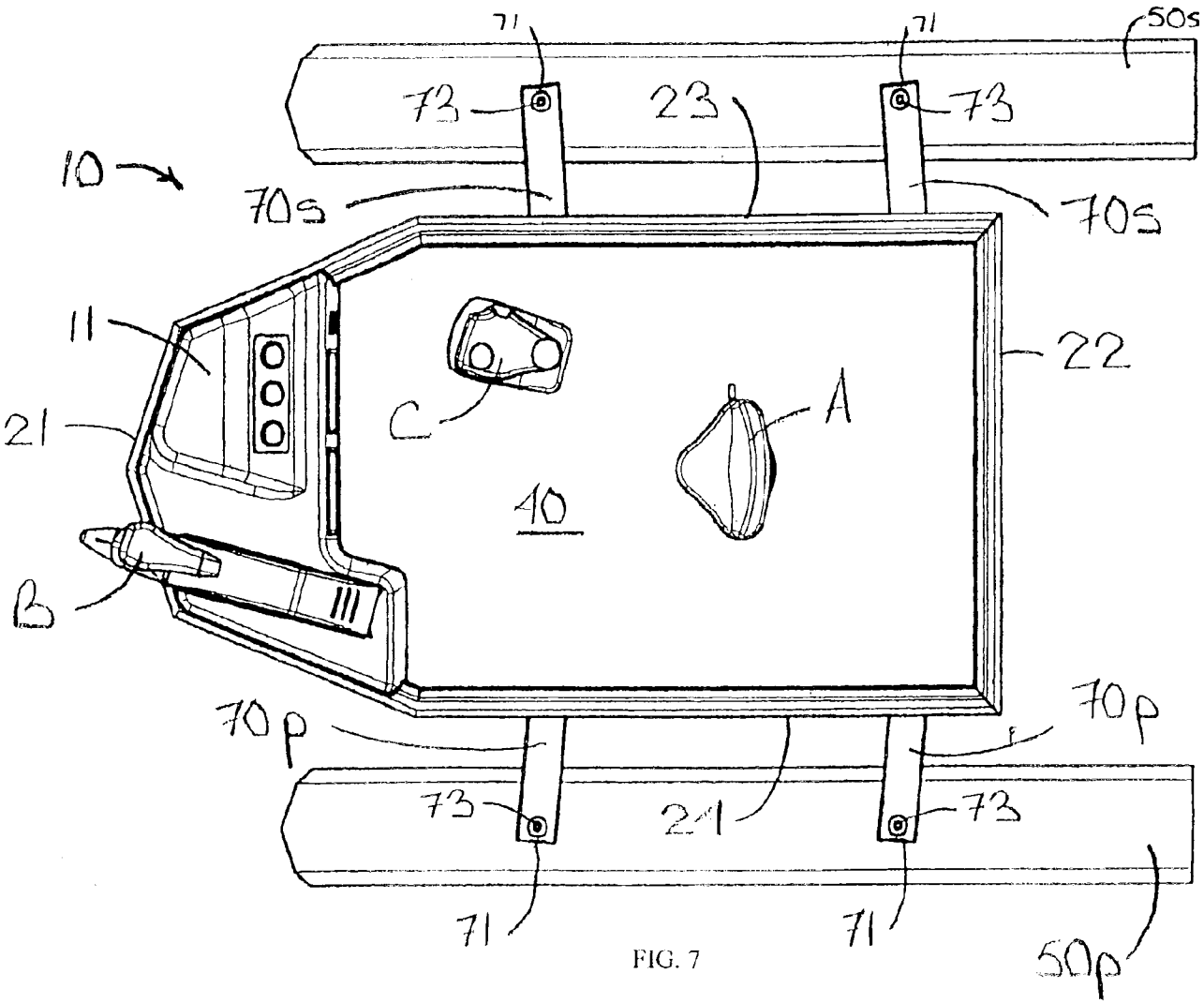
FIG. 7 is a top view of the invention shown in FIG. 1.

Referring generally to FIGS. 1 and 7, one embodiment of a first aspect of the invention is a watercraft 10 which includes a hull 20, a starboard pontoon 50*s* attached to the starboard side 23 of the hull 20 and a port pontoon 50*p* attached to the port side 24 of the hull 20.

Figure 21:
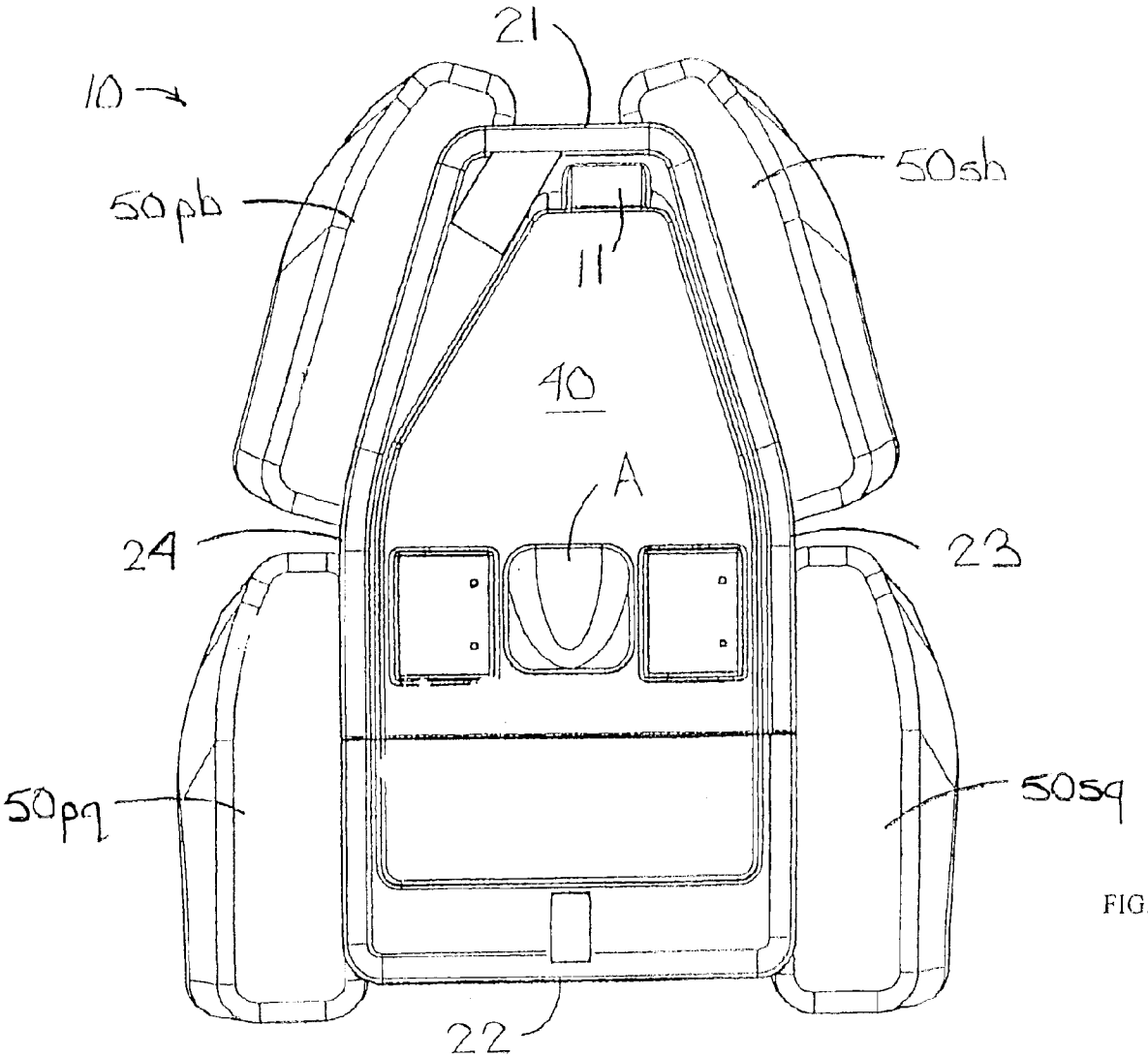
FIG. 21 is a top view of another embodiment of the personal watercraft aspect of in the invention equipped with a pedestal seat, with the pontoons placed in the flotation position and the connector links removed.

Referring generally to FIG. 21, another embodiment of the first aspect of the invention is a watercraft 10 which includes a hull 20, and four pontoons attached to the hull 20 with one pontoon 50*sb* positioned off a starboard bow (unnumbered) of the hull 20, one pontoon 50*sq* positioned off a starboard quarter (unnumbered) of the hull 20, one pontoon 50*pb* positioned off a port bow (unnumbered) of the hull 20, and one pontoon 50*pq* positioned off a port quarter (unnumbered) of the hull 20. The balance of the detailed description shall be provided in connection with the dual-pontoon embodiment of the personal watercraft 10. However, such description applies equally to the quad-pontoon embodiment as well as other embodiments of the personal watercraft 10 having any number of repositionable pontoons.

Figure 3:
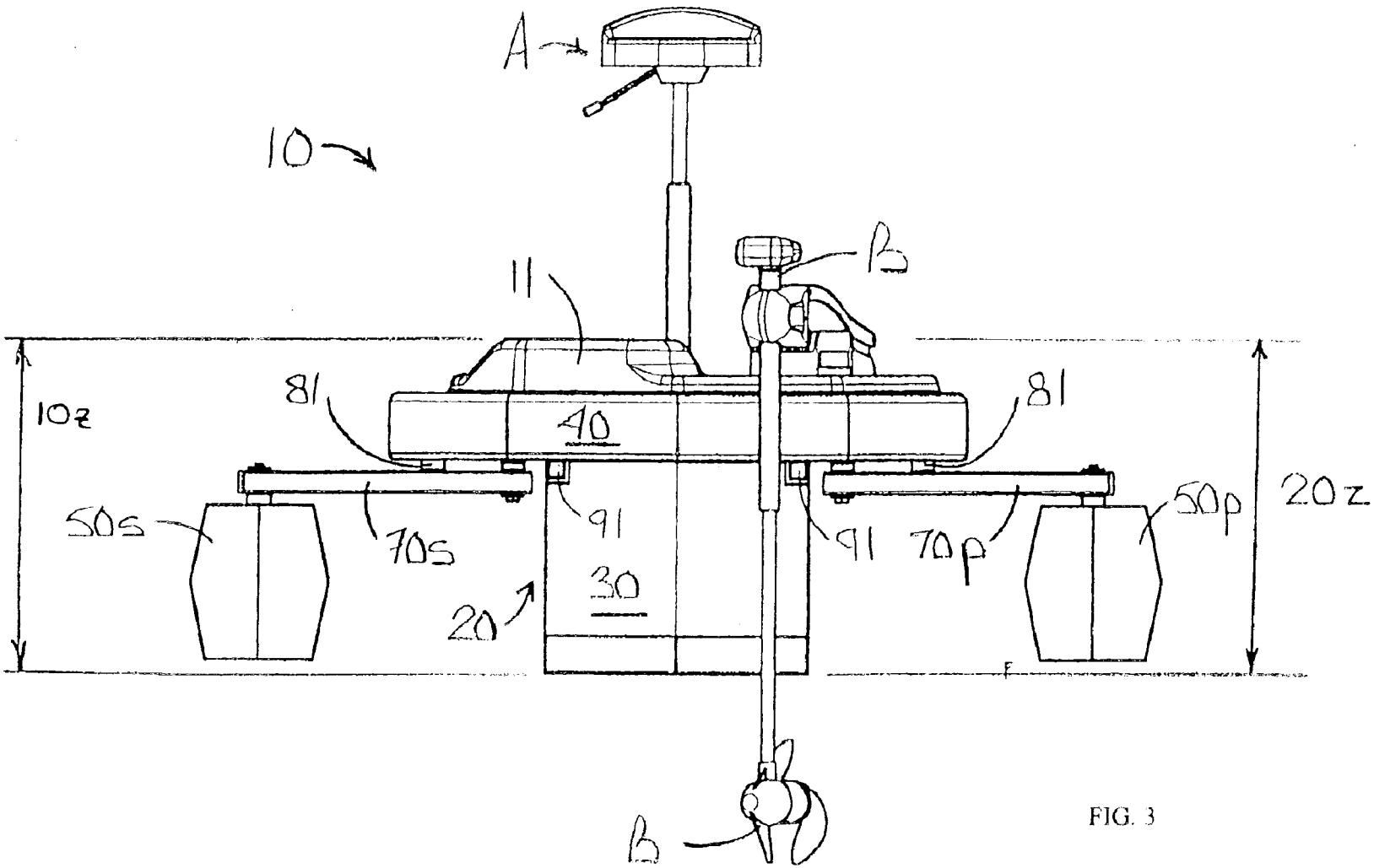
FIG. 3 is a front view of the invention shown in FIG. 1.
Figure 4:
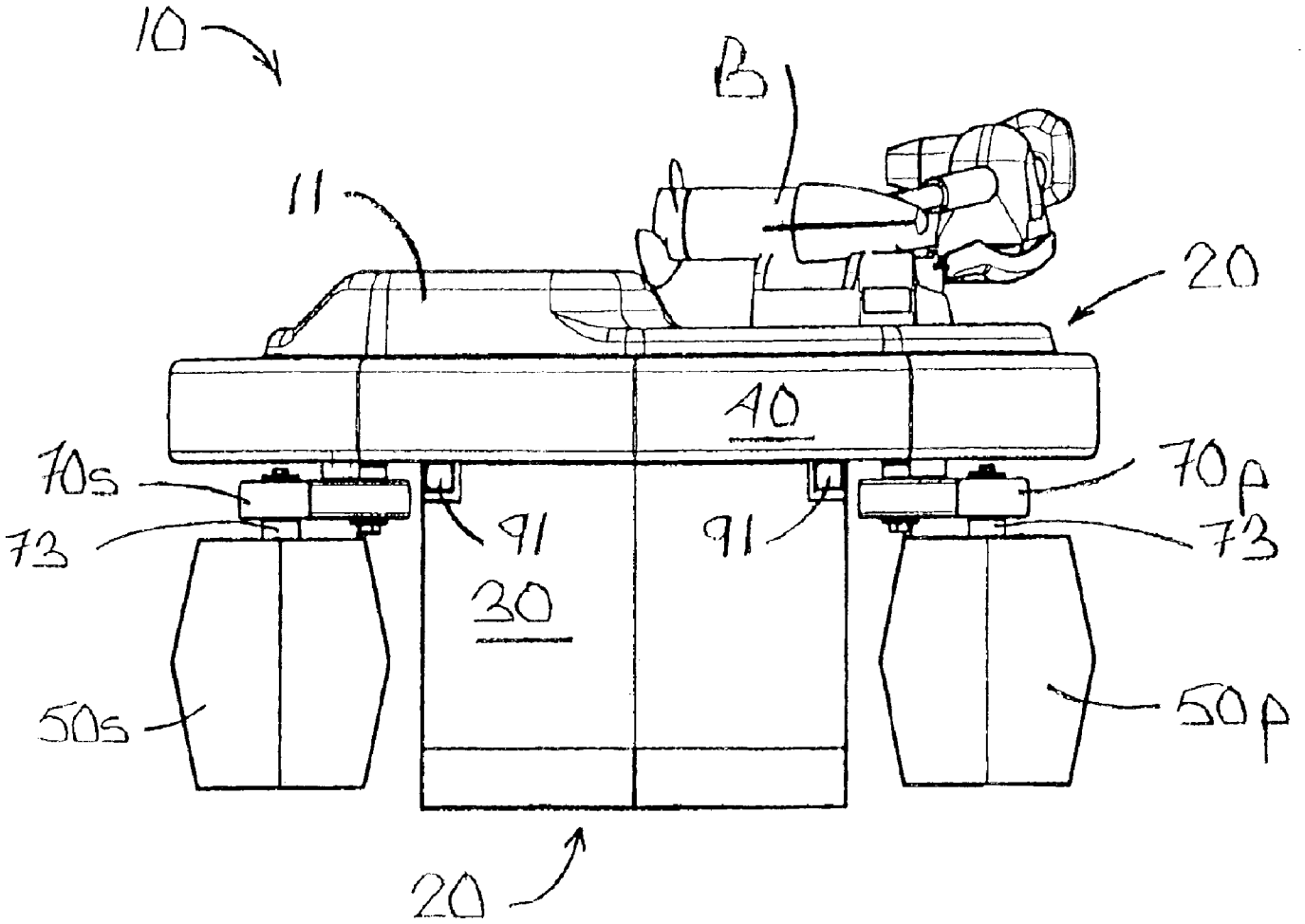
FIG. 4 is a front view of the invention shown in FIG. 3 with the pedestal seat removed, the trolling motor placed in a storage position and the pontoons placed in the storage position.
Figure 8:
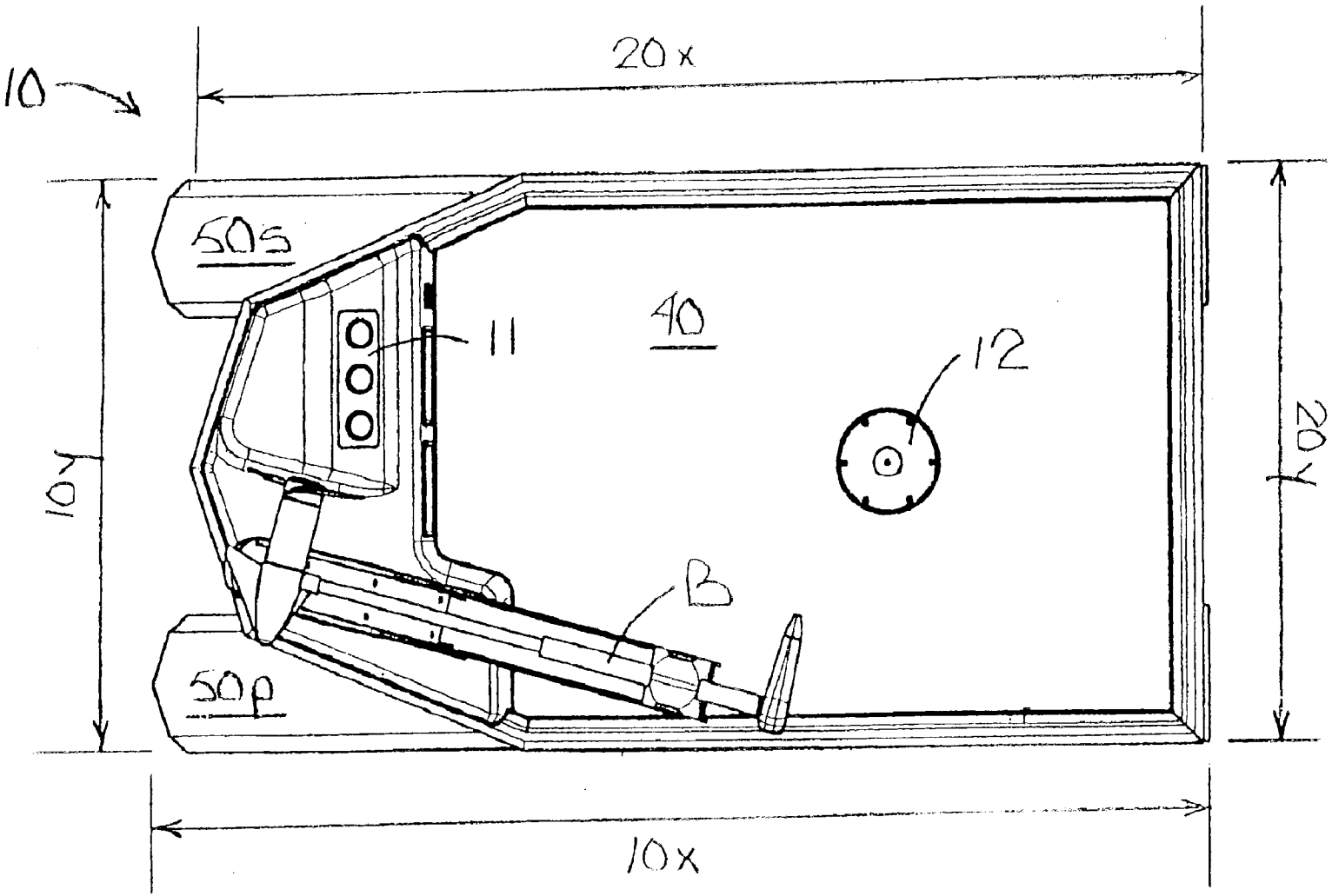
FIG. 8 is a top view of the invention shown in FIG. 7 with the pedestal seat removed, the trolling motor placed in a storage position and the pontoons placed in the storage position.
Figure 9:
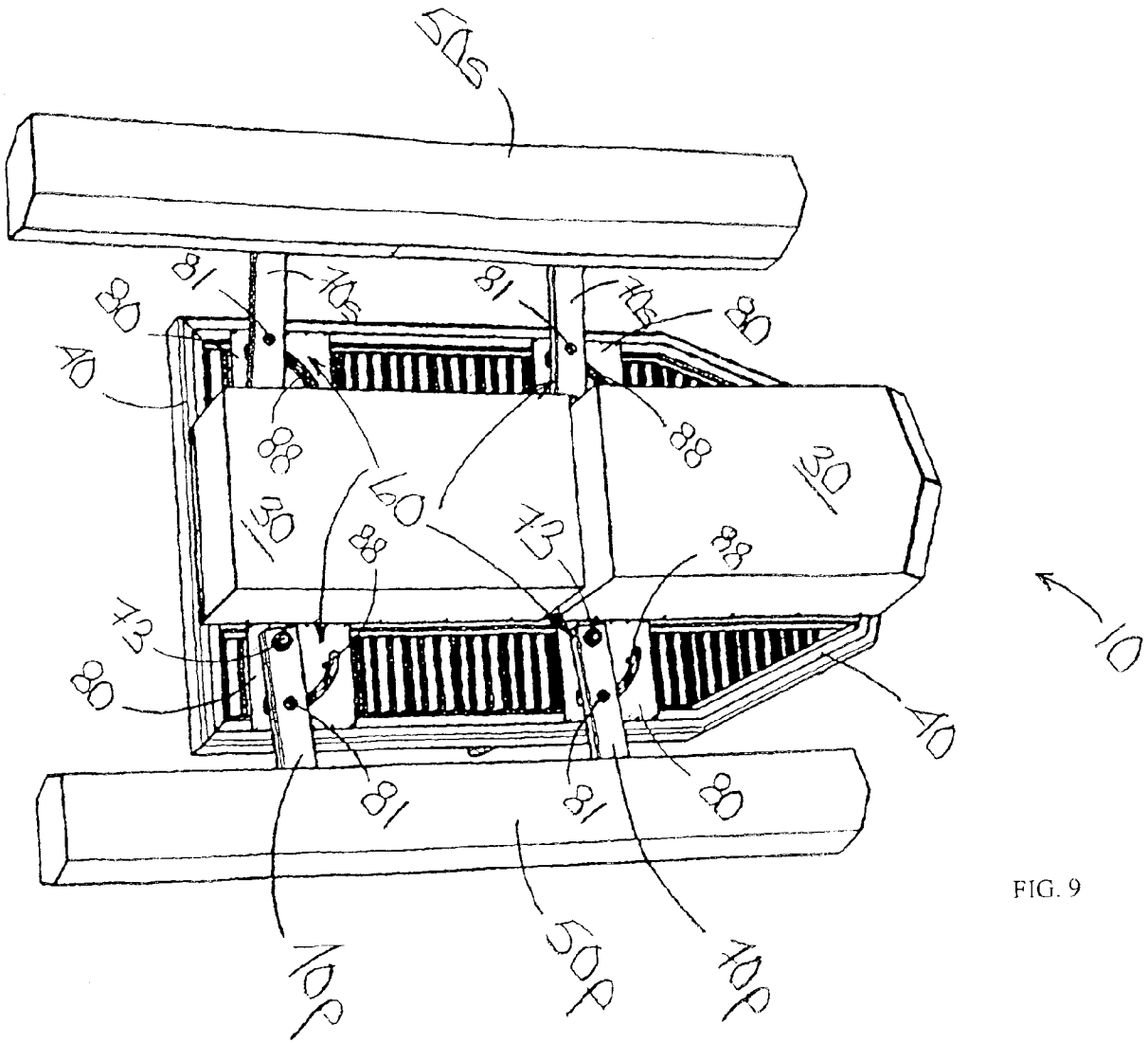
FIG. 9 is a lower perspective view from the port quarter of the invention shown in FIG. 1 with the trolling motor removed.

Referring generally to FIGS. 3 and 8, the watercraft 10 has a maximum longitudinal length 10*x* of about 6 feet to about 8 feet when the pontoons 50*s* and 50*p* are in the storage position, a maximum lateral width 10*y* of about 3 foot to about 4 feet when the pontoons 50*s* and 50*p* are in the storage position, and a maximum transverse height 10*z* of about 1 foot to about 3 feet. A maximum longitudinal length 10*x* of less than about 6 feet results in an upper deck surface area 41 which does not comfortably accommodate an individual and significantly reduces flotation stability of the watercraft 10, while a maximum longitudinal length 10*x* of greater than about 8 feet significantly reduces portability of the watercraft 10 as the watercraft 10 will not fit within the bed (not shown) of a standard full-sized truck (not shown). A maximum lateral width 10*y* of less than about 3 feet results in an upper deck surface area 41 which does not comfortably accommodate an individual and provides insufficient buoyancy, while a lateral width 10*y* of greater than about 4 feet significantly reducing portability of the watercraft 10 as the watercraft 10 will not fit within the bed (not shown) of a standard full-sized truck (not shown). A maximum transverse height 10*z* of less than about 1 foot provides insufficient buoyancy, while a maximum transverse height 10*z* of greater than about 3 feet significantly reduces portability of the watercraft 10 as the watercraft 10 becomes too large and too bulky for one or two persons to handle.

As shown in FIGS. 1 and 7, the hull 20 includes at least a bottom 30 and a deck 40, and defines a bow 21, a stern 22, a starboard side 23 and a port side 24. Referring generally to FIGS. 3 and 8, the hull 20 has a longitudinal overall length 20*x* of about 6 feet to about 8 feet, a lateral beam 20*y* of about 1 foot to about 2 feet, and a transverse height 20*z* of about 1 foot to about 3 feet. A longitudinal overall length 20*x* of less than about 6 feet results in an upper deck surface area 41 which does not comfortably accommodate an individual and significantly reduces flotation stability of the watercraft 10, while a longitudinal overall length 20*x* of greater than about 8 feet significantly reduces portability of the watercraft 10 as the watercraft 10 will not fit within the bed (not shown) of a standard full-sized truck (not shown). A lateral beam 20*y* of less than about 1 foot results in an upper deck surface area 41 which does not comfortably accommodate an individual and provides insufficient buoyancy, while a lateral beam 20*y* of greater than about 2 feet either (i) significantly reduces the width of the pontoons 50*s* and 50*p* thereby adversely affecting flotation stability of the watercraft 10, or (ii) significantly reducing portability of the watercraft 10 as the watercraft 10 will not fit within the bed (not shown) of a standard full-sized truck (not shown). A transverse height 20*z* of less than about 1 foot provides insufficient buoyancy, while a transverse height 20*z* of greater than about 3 feet significantly reduces portability of the watercraft 10 as the watercraft 10 becomes too large and too bulky for one or two persons to handle.

The deck 40 provides a substantially planar upper surface 41. The upper surface 41 is preferably sized to provide at least 16 $ft^2$ of planar surface area, most preferably at least 20 $ft^2$ of planar surface area.

Figure 2:
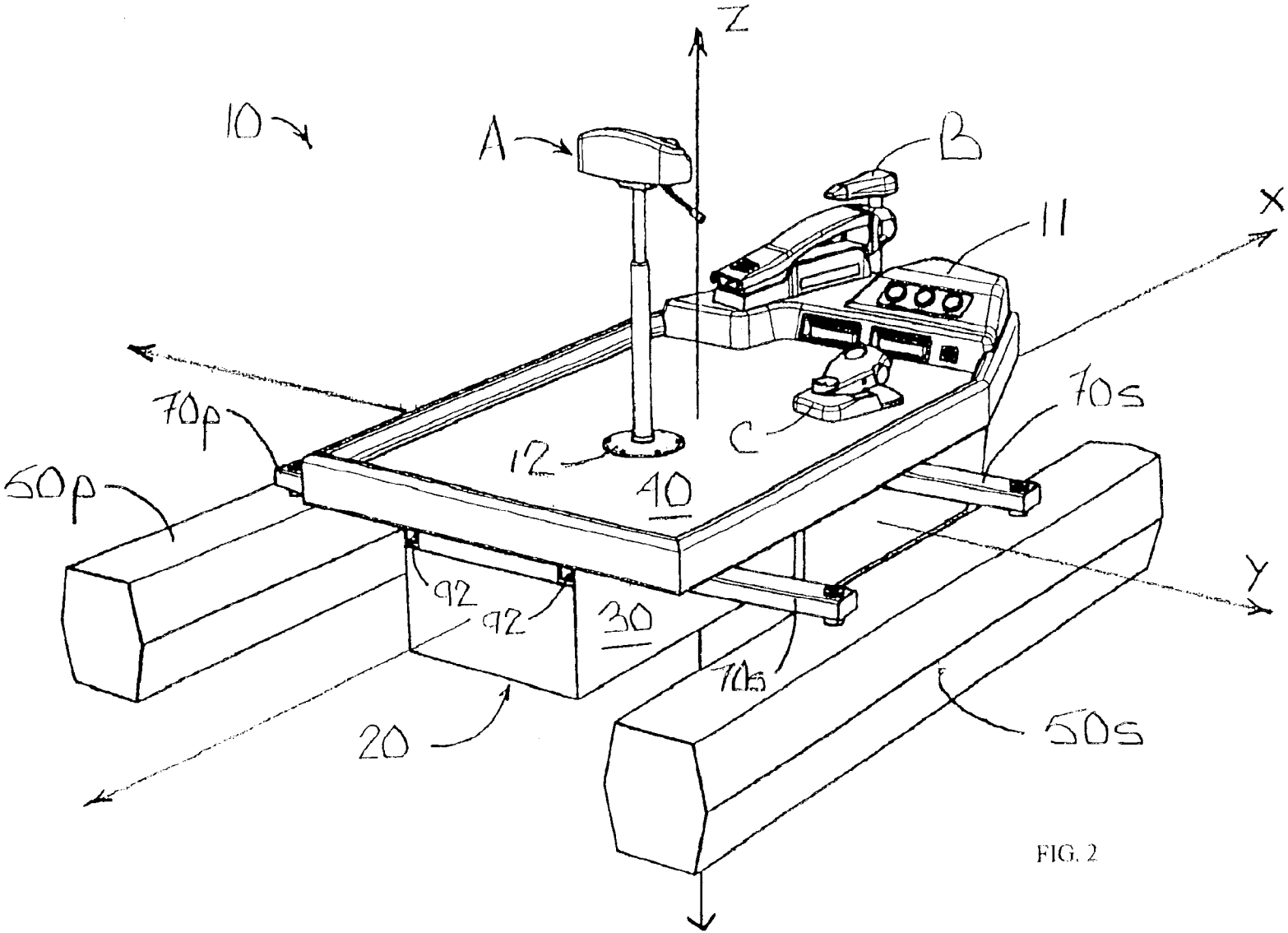
FIG. 2 is a top perspective view from the starboard quarter of the invention shown in FIG. 1.

Referring to FIG. 2, the hull 20 preferably also includes (i) a console 11 proximate the bow 21 of the hull 20 for housing power connections and a variety of monitoring devices commonly used on watercraft such as a compass (not shown), depth finder (not shown), time clock (not shown), etc., (ii) a socket 12 in the upper surface of the deck 41 for attachment of a seat A atop the deck 40 such as a standard pedestal seat, and/or (iii) an area for attachment of a trolling motor B and a foot pedal C for the trolling motor.

The hull 20 may be a single unitary element or, as shown in FIG. 1, multiple compartments.

Figure 10:
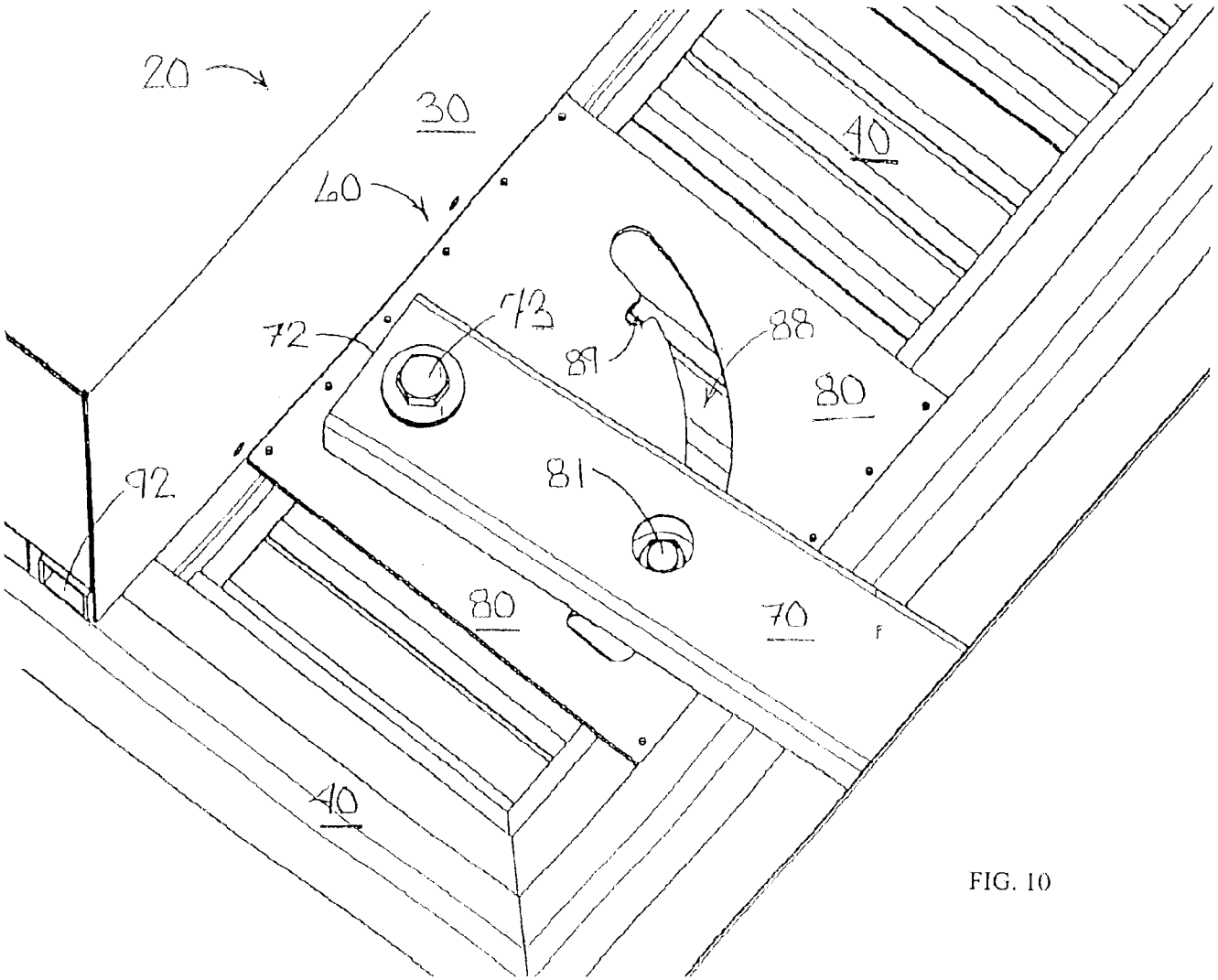
FIG. 10 is an enlarged view of one of the pivot connection assemblies on the invention shown in FIG. 9.
Figure 11A:
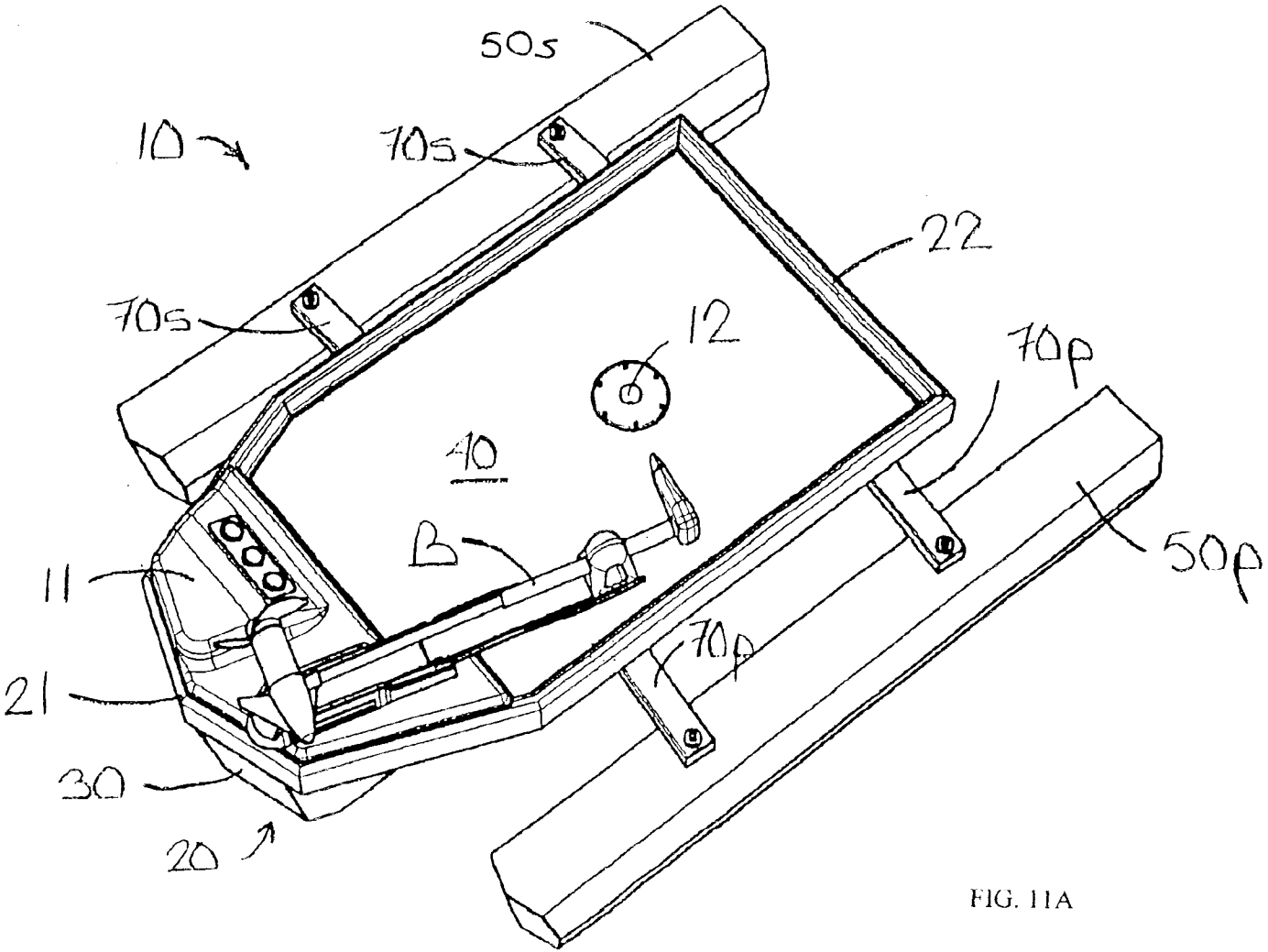
FIG. 11A is an upper perspective view from the port bow of the invention shown in FIG. 1 with the pedestal seat removed, trolling motor placed in a storage position and the pontoons placed in the flotation position.
Figure 11B:
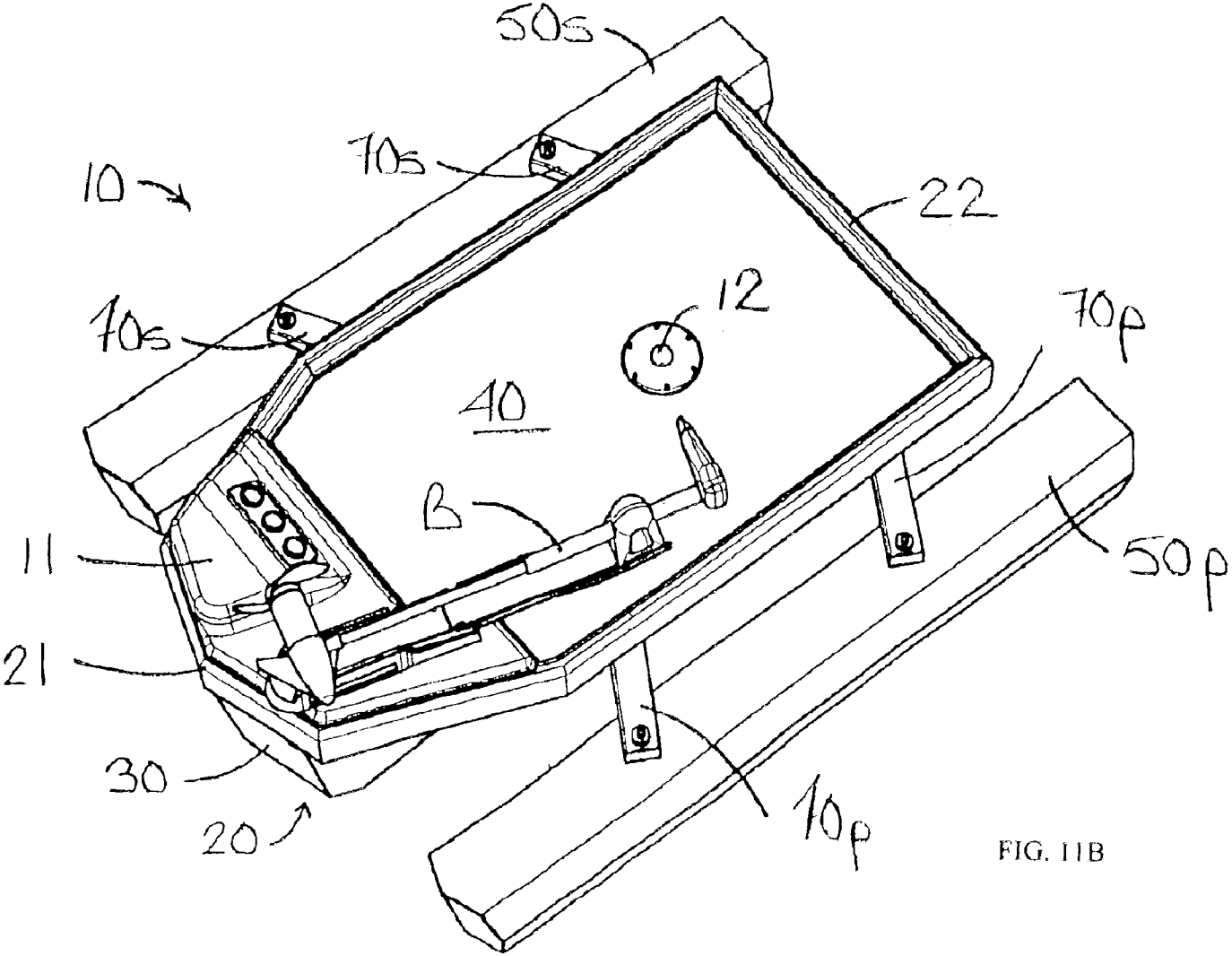
FIG. 11B is an upper perspective view from the port bow of the invention shown in FIG. 11A with the pontoons placed in a first intermediate position.
Figure 11C:
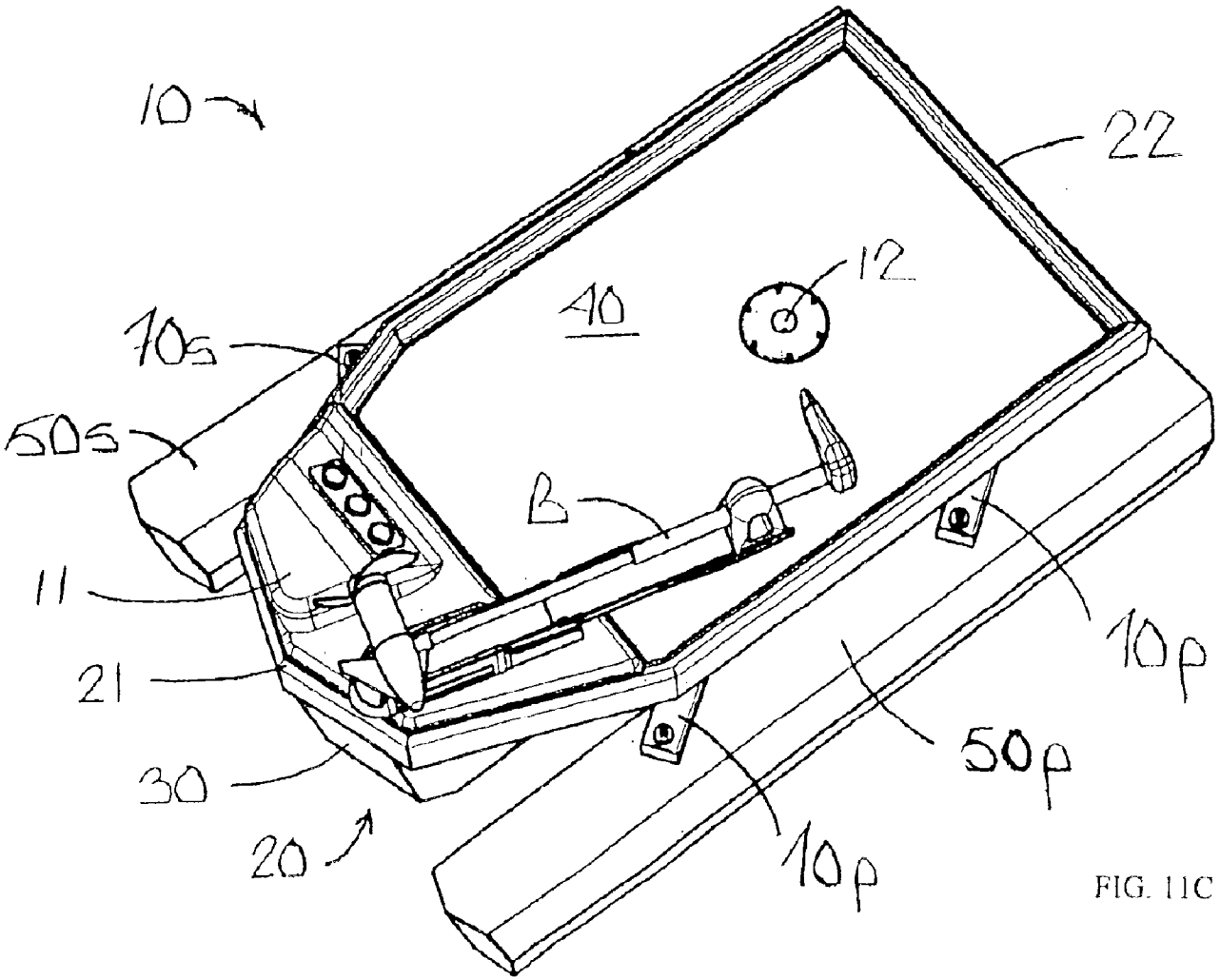
FIG. 11C is an upper perspective view from the port bow of the invention shown in FIG. 11A with the pontoons placed in a second intermediate position.
Figure 11D:
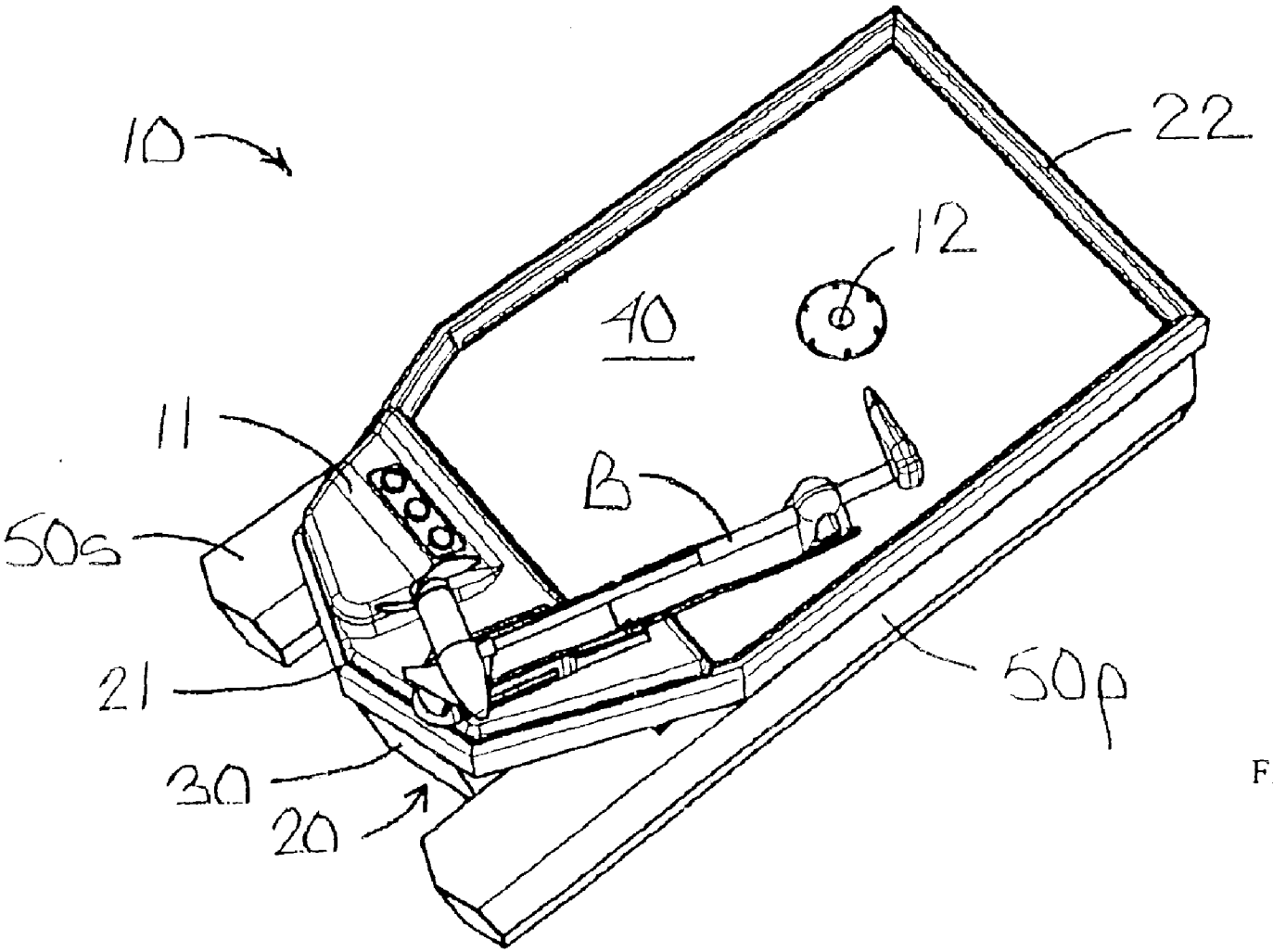
FIG. 11D is an upper perspective view from the port bow of the invention shown in FIG. 11A with the pontoons placed in the storage position.
Figure 12:
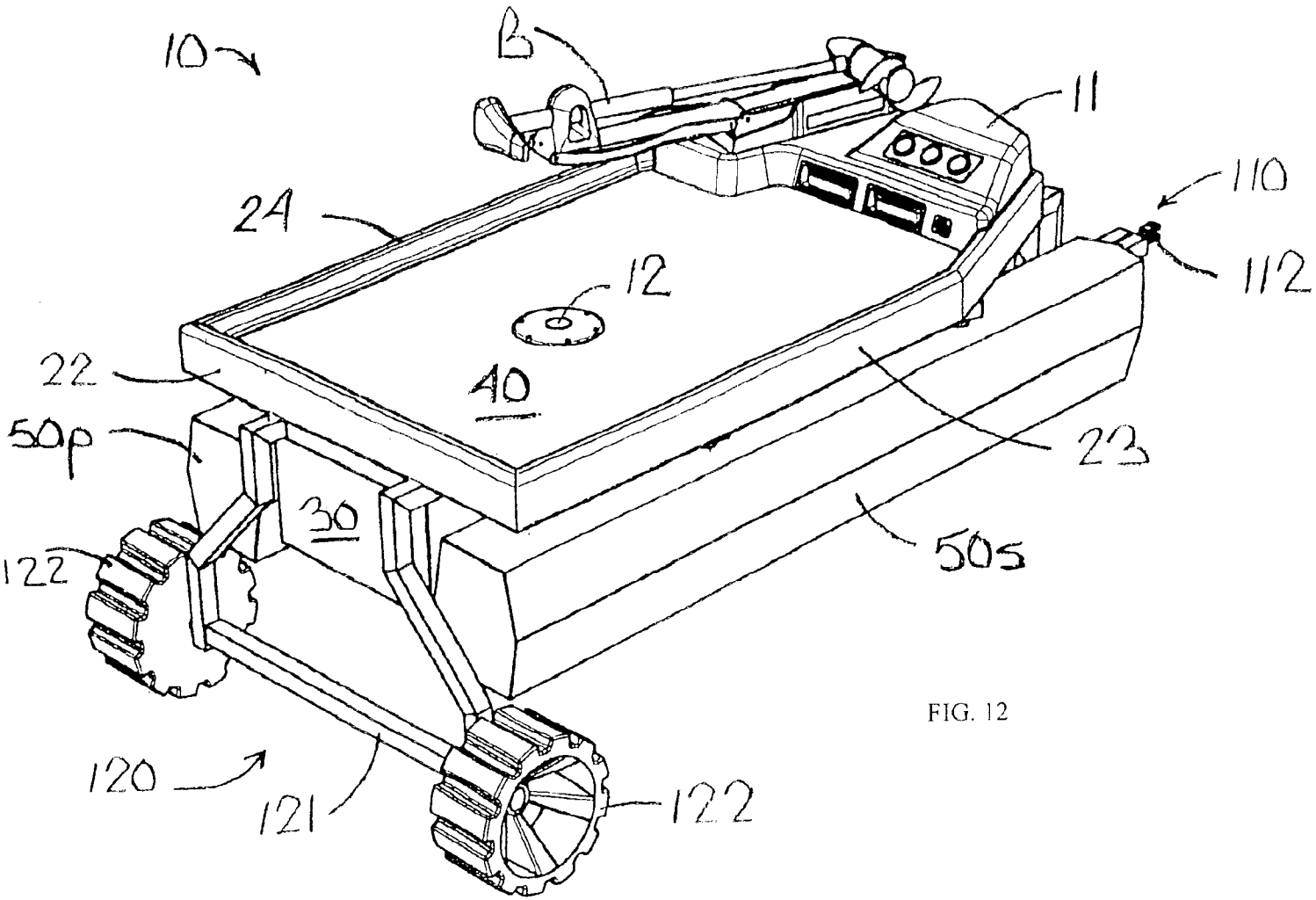
FIG. 12 is an upper perspective view from the starboard quarter of the invention shown in FIG. 1 with the pedestal seat removed, the trolling motor placed in a storage position, the pontoons placed in the storage position, a towing attachment engaged within the hitch attachments proximate the bow of the personal watercraft and a wheeled attachment engaged within the hitch attachments proximate the stern of the personal watercraft.
Figure 13:
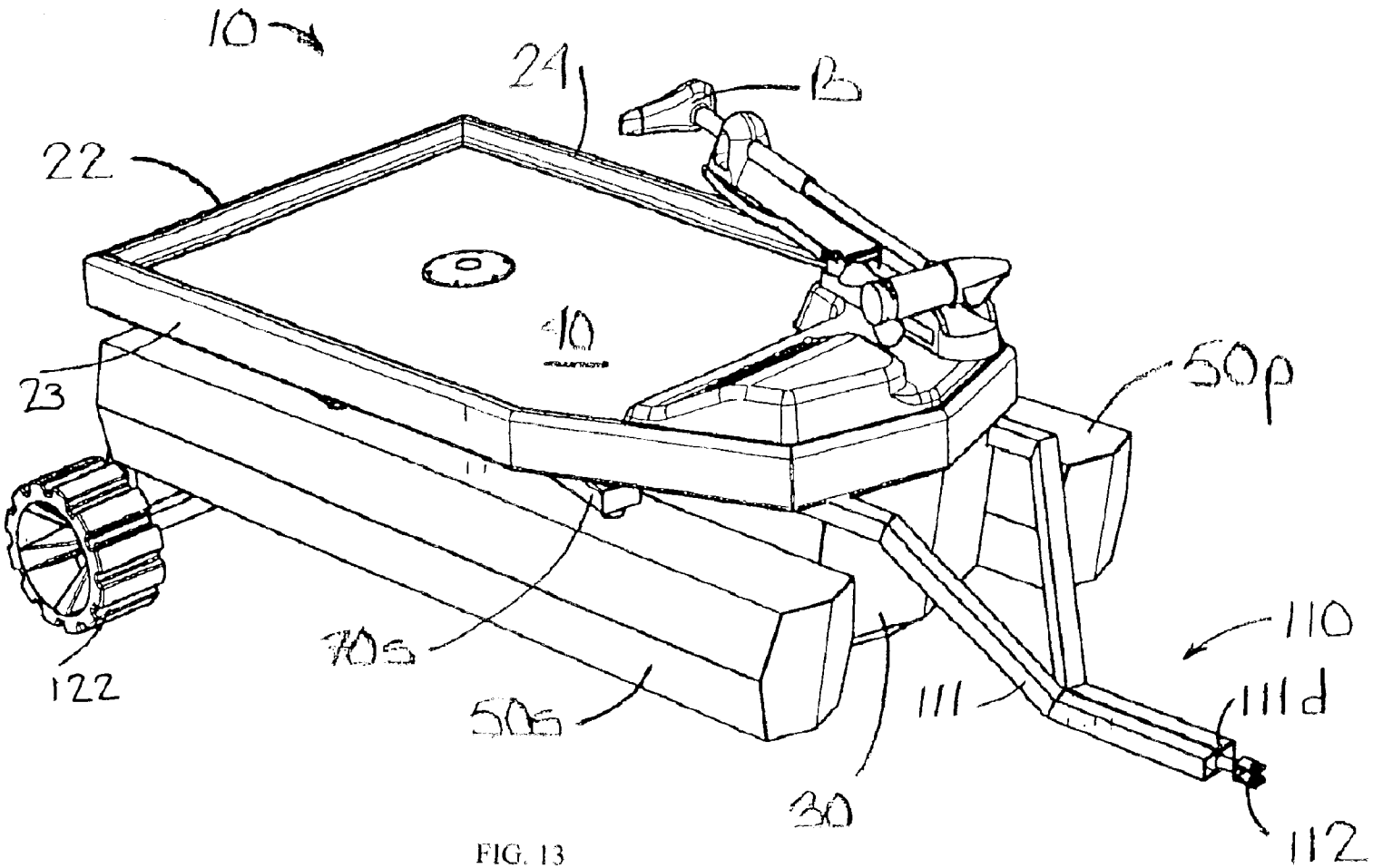
FIG. 13 is an upper perspective view from the starboard bow of the invention shown in FIG. 12.
Figure 14:
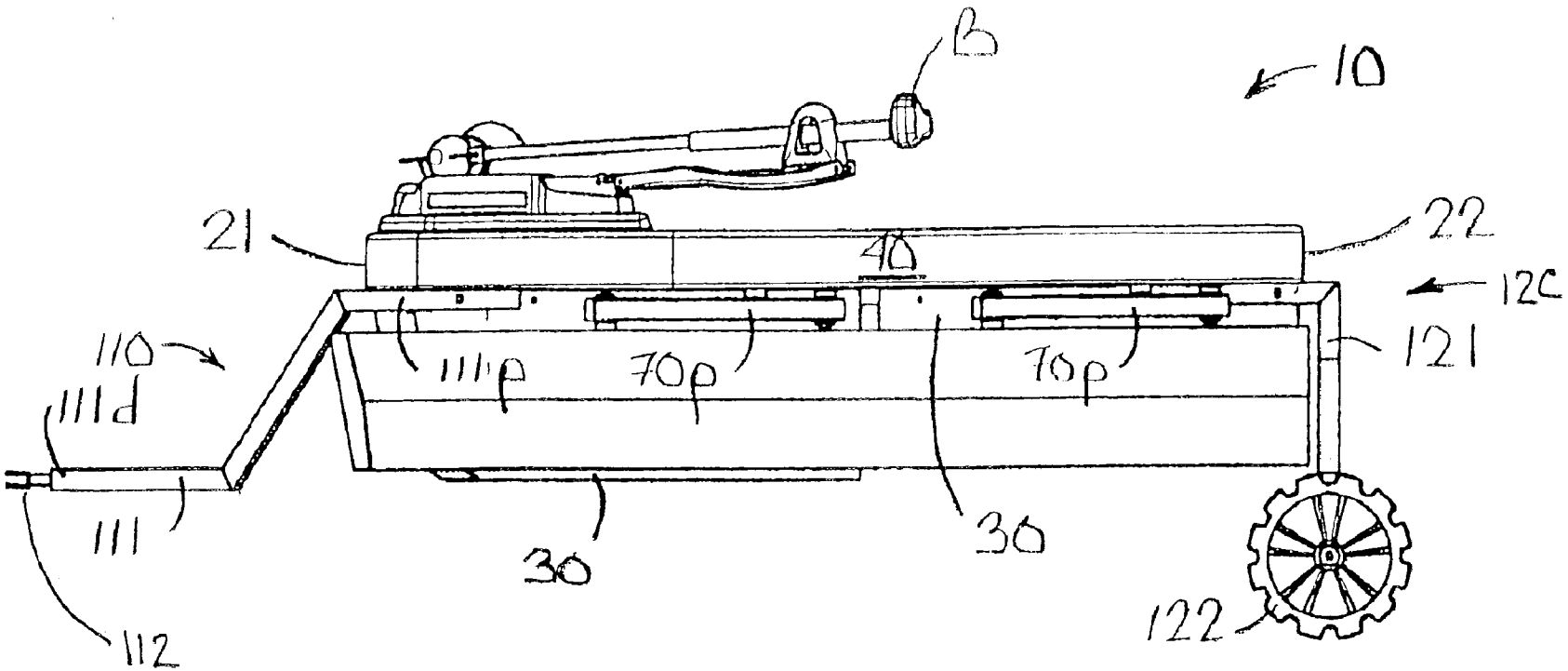
FIG. 14 is a port side view of the invention shown in FIG. 12.
Figure 15:
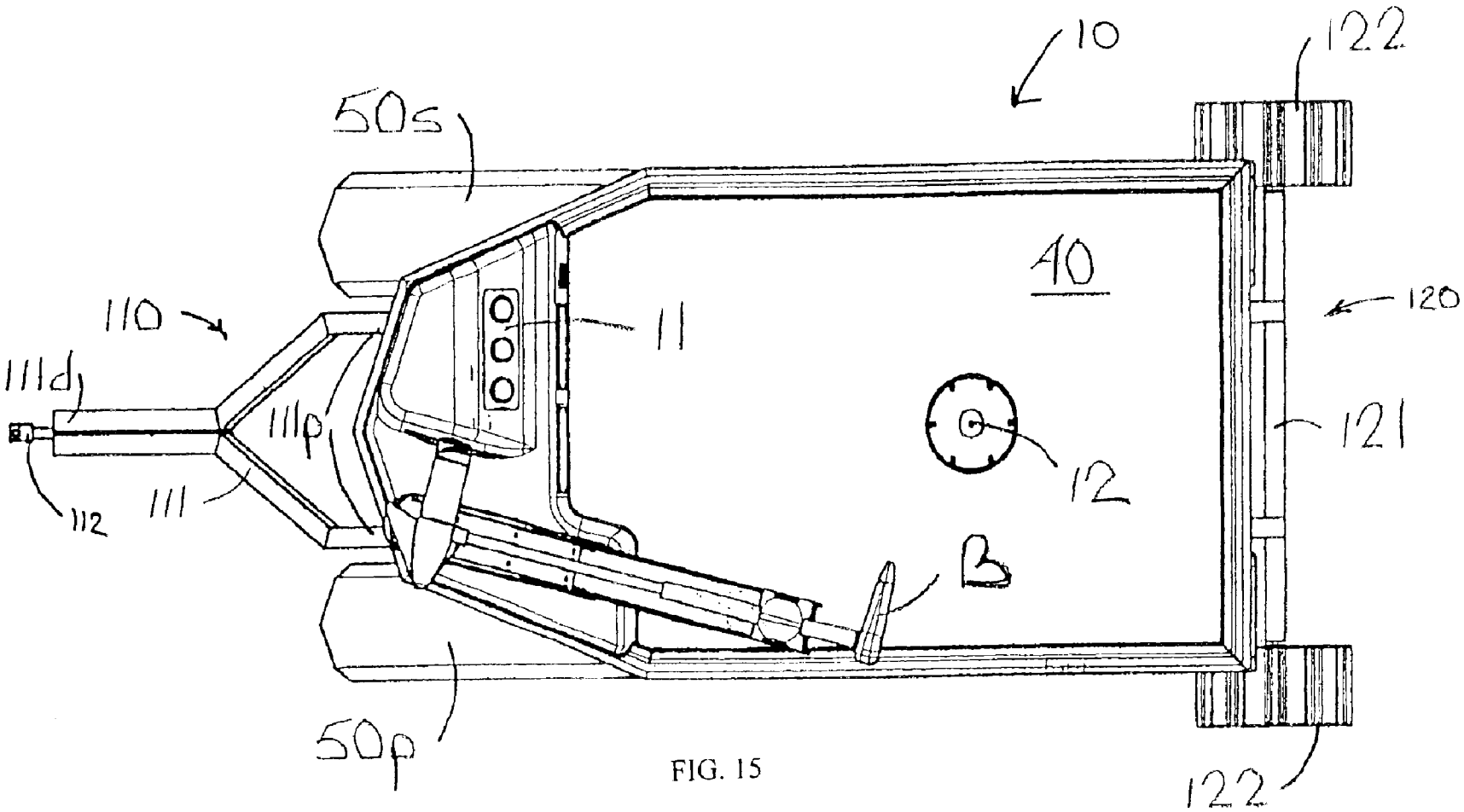
FIG. 15 is a top view of the invention shown in FIG. 12.

Referring generally to FIGS. 7 and 10, the pontoons 50*s* and 50*p* are each repositionably attached to the hull 20 by a pair of connector assemblies 60. Each connector assembly 60 includes a connector link 70 with a pair of longitudinally spaced starboard connector links 70*s* attaching the starboard pontoon 50*s* to the hull 20 and a pair of longitudinally spaced port connector links 70*p* attaching the port pontoon 50*p* to the hull 20.

Figure 5:
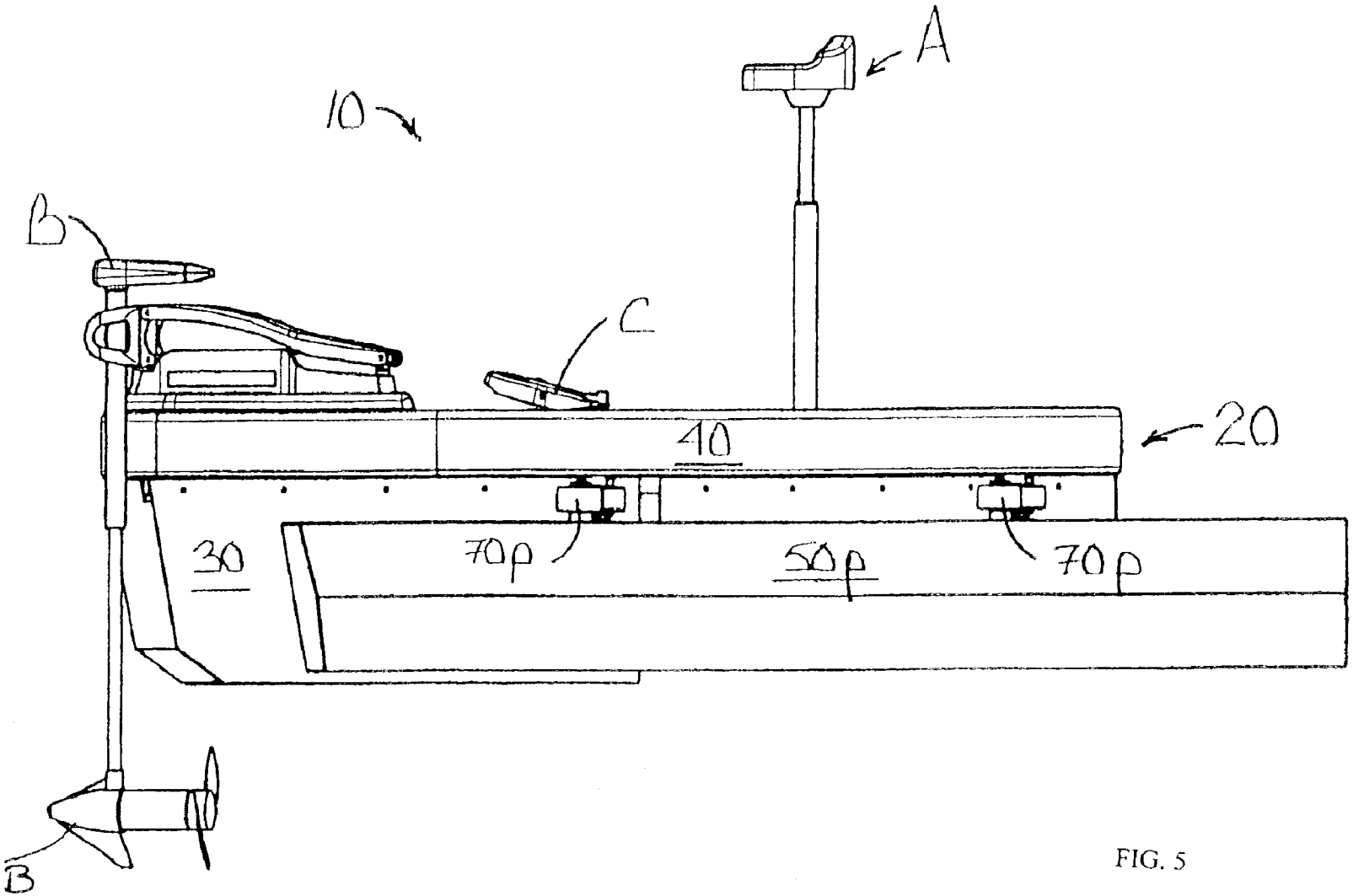
FIG. 5 is a port side view of the invention shown in FIG. 1.
Figure 6:
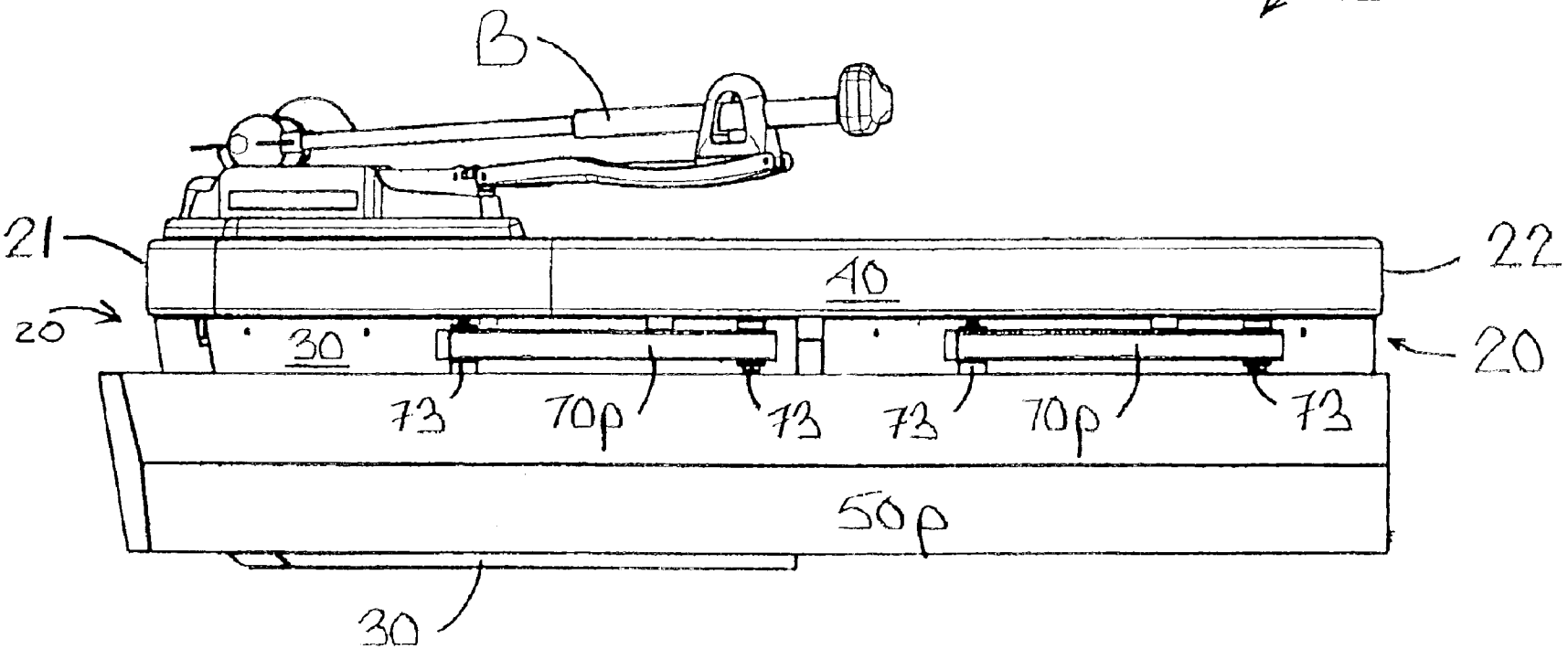
FIG. 6 is a port side view of the invention shown in FIG. 5 with the pedestal seat removed, the trolling motor placed in a storage position and the pontoons placed in the storage position.

As shown in FIGS. 5 through 8, the connector links 70 are pivotably attached to the hull 20 and the pontoons 50*s* and 50*p* so as to permit lateral and longitudinal repositioning of the pontoons 50*s* and 50*p* relative to the hull 20 as between a storage position, such as shown in FIGS. 5 and 7, having a generally longitudinally aligned storage position relative to the hull 20 and a minimized lateral distance between the pontoons 50*s* and 50*p*, and a flotation position, such as shown in FIGS. 6 and 8, having a longitudinal flotation position shifted aft relative to the longitudinally aligned storage position and a maximized lateral distance between the pontoons 50*s* and 50*p*.

As shown in FIGS. 7 and 10, a proximal end 72 of each connector link 70 is pivotably attached to the hull 20 by a connector bolt 73 for pivoting about a transverse pivot axis (unnumbered), and a distal end 71 of each connector link 70 is pivotably attached to a pontoon 50*s* or 50*p* by another connector bolt 73 for pivoting about another transverse pivot axis (unnumbered).

As shown in FIG. 10, the pontoons 50*s* and 50*p* may be locked into position as between the storage position, the flotation position and any number of intermediate positions by a connector plate 80 positioned between the hull 20 and the proximal end 72 of each connector link 70. The connector plate 80 has an arc-shaped channel 88 centered about the transverse pivot axis (unnumbered) created by the connector bolt 73 attaching the proximal end 72 of the connector link 70 to the hull 20. A locking pin 81 transversely extends from each connector link 70 into the arc-shaped channel 88 of the corresponding connector plate 80 and travels along the length of the arc-shaped channel 88 as the pontoon 50*s* or 50*p* to which the connector link 70 is attached, is repositioned. A series of locking notches 89 spaced along the length of the arc-shaped channel 88 extend radially inward from the arc-shaped channel 88. The locking pin 81 is radially biased by a biasing means, such as a spring (not shown), towards the locking notches 89, thereby causing the locking pin 81 to move into a locking notch 89 and thereby resist further repositioning of the pontoon 50*s* or 50*p* to which the connector link 70 is attached by resisting further pivoting of the connector link 70, when the locking pin 81 is radially aligned with a locking notch 89.

An alternative system for rendering the pontoons 50*s* and 50*p* longitudinally and laterally repositionable is a railing system (not shown) including (i) a longitudinally extending track (not shown) attached to the underside (unnumbered) of the deck 40 proximate each of the starboard 23 and port 24 sides of the watercraft 10, (ii) a pair of longitudinally spaced laterally extending supports (not shown) fixedly attached to the top (unnumbered) of each pontoon 50*s* and 50*p* with a laterally extending track (not shown) attached to the topside (not shown) of each lateral support (not shown), and (iii) a longitudinally extending support (not shown) with (A) a first traveler member (not shown) for slidably engaging the longitudinal track (not shown) attached to the deck 40 and thereby permitting longitudinal movement of the longitudinal support (not shown) along the longitudinal track (not shown), and (B) a second traveler member (not shown) for slidably engaging the lateral track (not shown) attached to the lateral support (not shown) and thereby permitting lateral movement of the lateral support (not shown) relative to the longitudinal support (not shown).

Referring generally to FIGS. 7 and 10, the pontoons 50*s* and 50*p* are each repositionably attached to the hull 20 by a pair of connector assemblies 60.

Other means for controlling repositioning of the pontoons 50*s* or 50*p* are known to those skilled in the art and include hydraulic systems, pneumatic systems, electrical systems, and mechanical systems such as a pawl and ratchet system, a worm gear system, etc.

The starboard pontoon 50*s* and port pontoon 50*p* are preferably independently repositionable, but may be interconnected for coincidental repositioning so that repositioning of one pontoon 50*s* or 50*p* effects a corresponding repositioning of the other pontoon 50*s* or 50*p*.

Referring generally to FIG. 21, in a similar fashion each of the starboard bow 50*sb*, starboard quarter 50*sq*, port bow 50*pb* and port quarter 50*pq* pontoons are preferably each independently repositionable, but may be interconnected so as to provide for (i) coincidental repositioning of the starboard bow 50*sb* and starboard quarter 50*sq* pontoons, (ii) coincidental repositioning of the port bow 50*pb* and port quarter 50*pq* pontoons, (iii) coincidental repositioning of the starboard bow 50*sb* and port bow 50*pb* pontoons, (iv) coincidental repositioning of the starboard quarter 50*sq* and port quarter 50*pq* pontoons, or (v) coincidental repositioning of the starboard bow 50*sb*, starboard quarter 50*sq*, port bow 50*pb*, and port quarter 50*pq* pontoons.

Referring generally to FIGS. 1 through 4, one embodiment of a second aspect of the invention is a watercraft 10 which includes a hull 20, and one or both of (i) a pair of laterally spaced hitch attachments 91 secured to the hull 20 proximate the bow 21 of the bull 20, and/or (ii) a pair of laterally spaced hitch attachments 92 secured to the hull 20 proximate the stern 22 of the hull 20.

The hitch attachments 91 and 92 are preferably attached as a permanent component of the hull 20 and may be selected from any of the numerous types of vehicle-mounted hitches known to those skilled in the art, but is preferably the widely-available universal squarechannel receiver hitch.

A wide variety of accessories may be beneficially attached to the watercraft 10 equipped with the hitch attachments 91 and/or 92, including a towing attachment 110, a wheeled attachment 120, a transom attachment 130, an interconnect linkage 140 and a supplemental decking attachment 150.

Referring generally to FIGS. 12 through 15, one embodiment of a towing attachment 110 includes a longitudinally extending frame 111, such as a Y-shaped yoke, with (i) a pair of laterally spaced elements (not shown) proximate the proximal longitudinal end 111*p* of the towing attachment 110 configured and arranged for cooperatively releasably engaging the pair of hitch attachments 91 secured to the hull 20 proximate the bow 21, and (ii) a hitch attachment 112 proximate the distal longitudinal end 111*d* of the towing attachment 110. The towing attachment 110, when used in combination with the wheeled attachment 120, permits towing of the watercraft 10 by a motorized vehicle such as an ATV, lawn tractor, automobile, etc.

Referring generally to FIGS. 12 through 15, one embodiment of a wheeled attachment 120 includes a frame 121, such as a generally U-shaped yoke, with (i) at least one element (not shown), preferably two elements (not shown), configured and arranged for cooperatively releasably engaging a hitch attachment 92 secured to the hull 20 proximate the stern 22, and (ii) at least one wheel 122, preferably two laterally spaced wheels 122, configured and arranged on the frame 121 such that the wheel(s) 122 transversely extend below the bottom 30 of the hull 20 when the element(s) (not shown) on the wheeled attachment 120 is engaged with the hitch attachment(s) 92 secured to the hull 20 proximate the stern 22.

Figure 16:
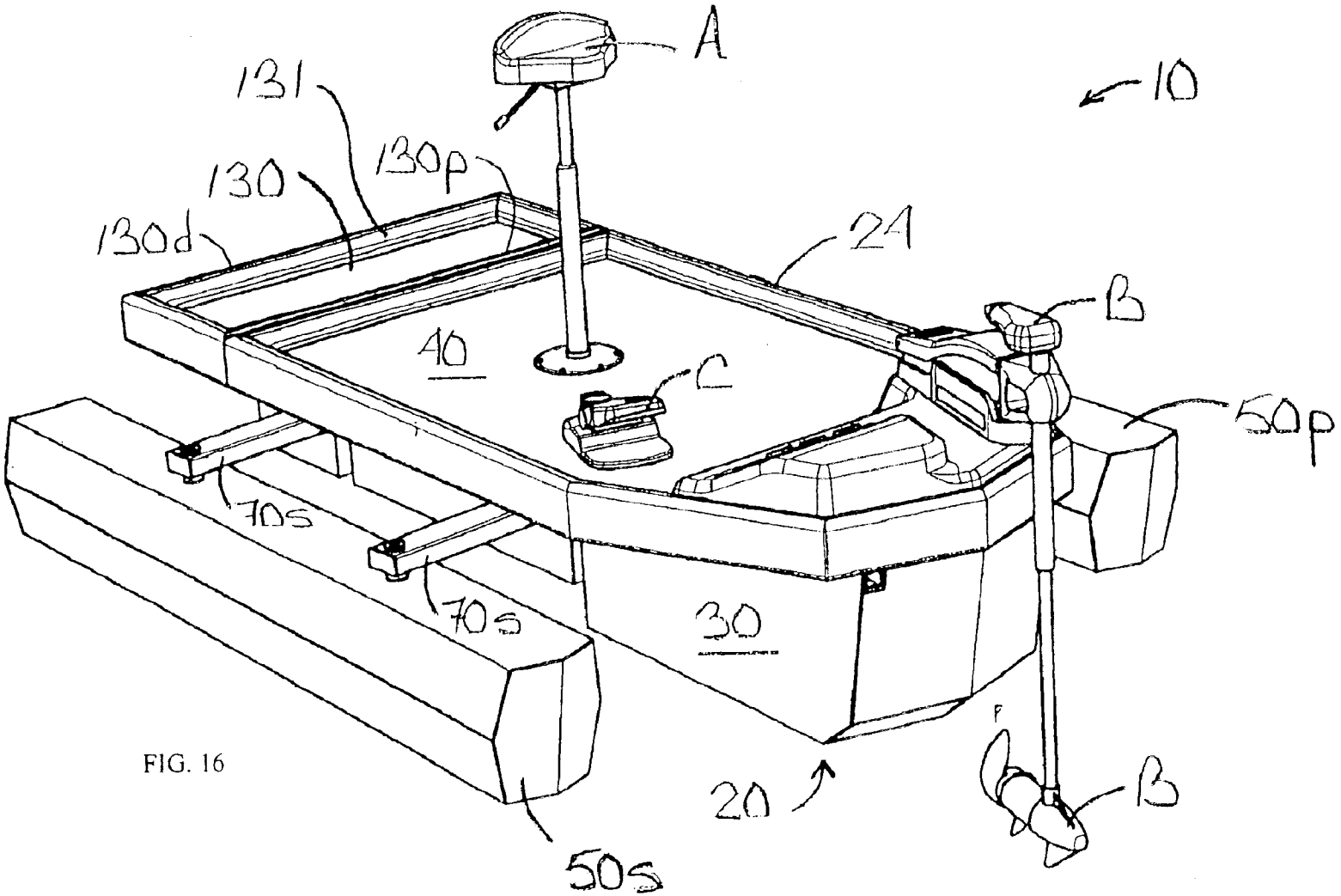
FIG. 16 is an upper perspective view from the starboard bow of the invention shown in FIG. 1 with a transom attachment engaged within the hitch attachments proximate the stern of the personal watercraft.

Referring generally to FIG. 16, one embodiment of a transom attachment 130 has (i) a pair of elements (not shown) proximate a proximal longitudinal end 130*p* of the transom attachment 130 configured and arranged for cooperatively releasably engaging the pair of hitch attachments 92 secured to the hull 20 proximate the stern 22, and (ii) a laterally extending beam 131 proximate a distal longitudinal end 130*d* of the transom attachment 130 configured and arranged for supporting a boat motor (not shown) in an operable position.

Figure 17:
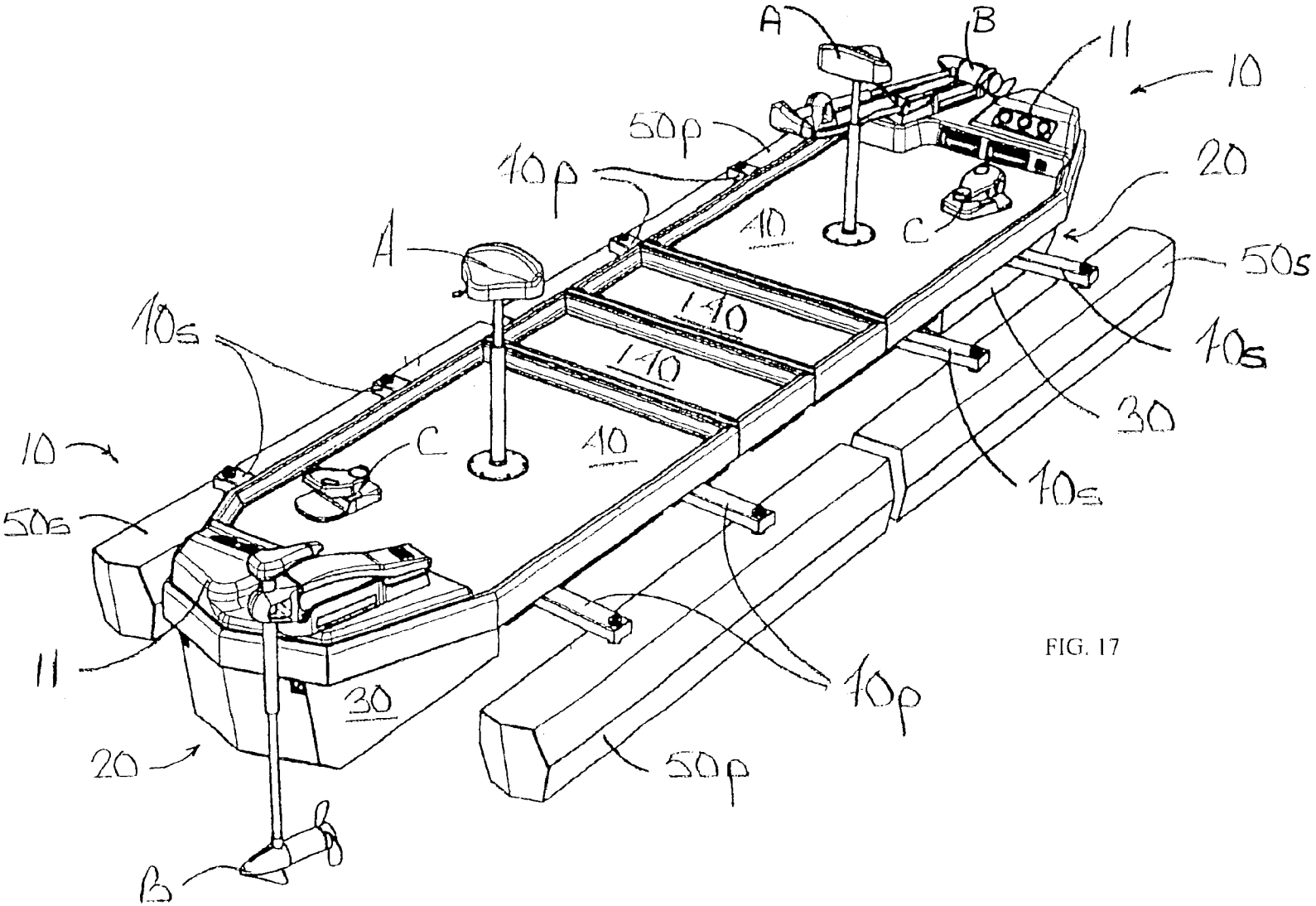
FIG. 17 is an upper perspective view of two of the inventions shown in FIG. I attached stern-to-stern via a pair of interconnect linkages with one trolling motor placed in a trolling position and the other trolling motor placed in a storage position.
Figure 18:
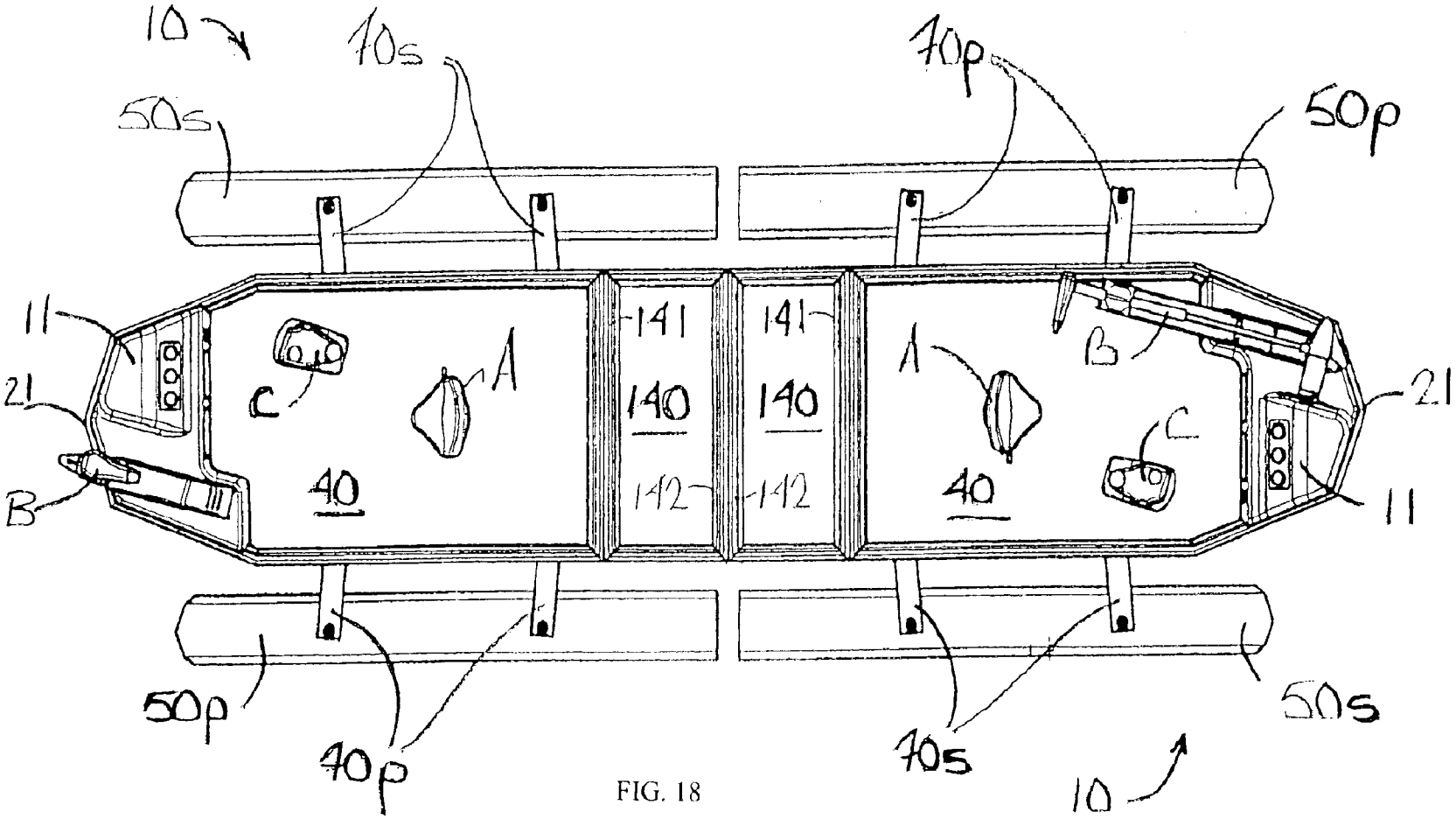
FIG. 18 is a top view of the attached inventions shown in FIG. 17.

Referring generally to FIGS. 17 and 18, one embodiment of an interconnect linkage 140 has (i) at least one and preferably two first elements (not shown) proximate a first longitudinal end 141 of the interconnect linkage 140 configured and arranged for cooperatively releasably engaging a hitch attachment(s) 92 secured to the hull 20 proximate the stern 22, and (ii) at least one and preferably two second elements (not shown) proximate a second longitudinal end 142 of the interconnect linkage 140 configured and arranged for cooperatively releasably engaging a hitch attachment(s) 92 secured to the hull 20 proximate the stern 22. The interconnect linkage 140 thereby functions to stably interconnect two of the personal watercraft 10 in a stern-to-stern fashion.

As shown in FIGS. 17 and 18, multiple interconnect linkages 140 can also be interconnected when desired by use of an adapter (not shown) permitting the connection of the second element (not shown) on two different interconnect linkages 140.

As shown in FIGS. 17 and 18, the interconnect linkage 140 preferably provides an upper planar surface (not numbered) for facilitating movement between two interconnected watercraft 10 and/or facilitating storage of items on the interconnect linkage 140.

Figure 19:
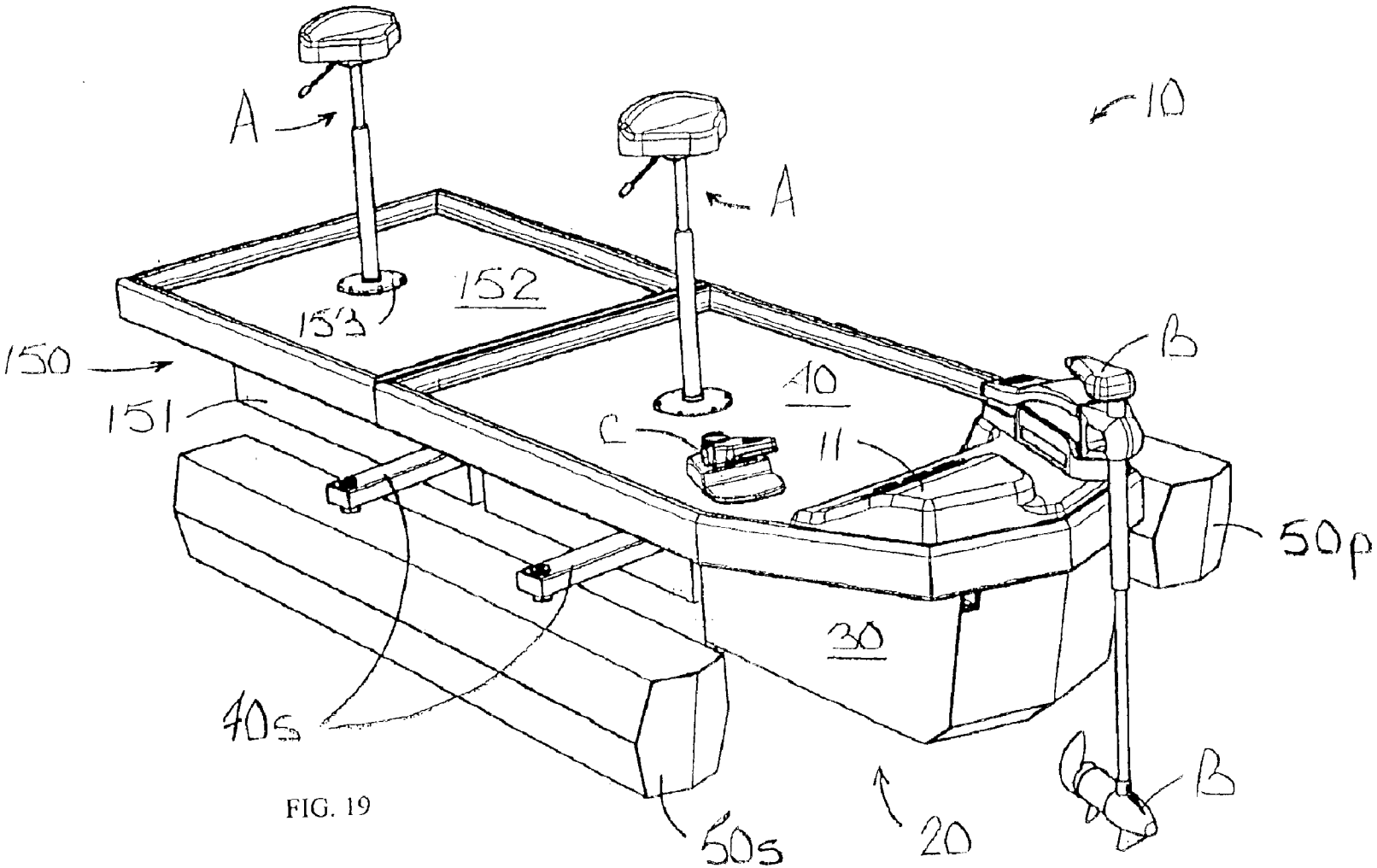
FIG. 19 is an upper perspective view from the starboard bow of the invention shown in FIG. 1 with a supplemental decking attachment equipped with a pedestal seat and engaged within the hitch attachments proximate the stern of the personal watercraft.
Figure 20:
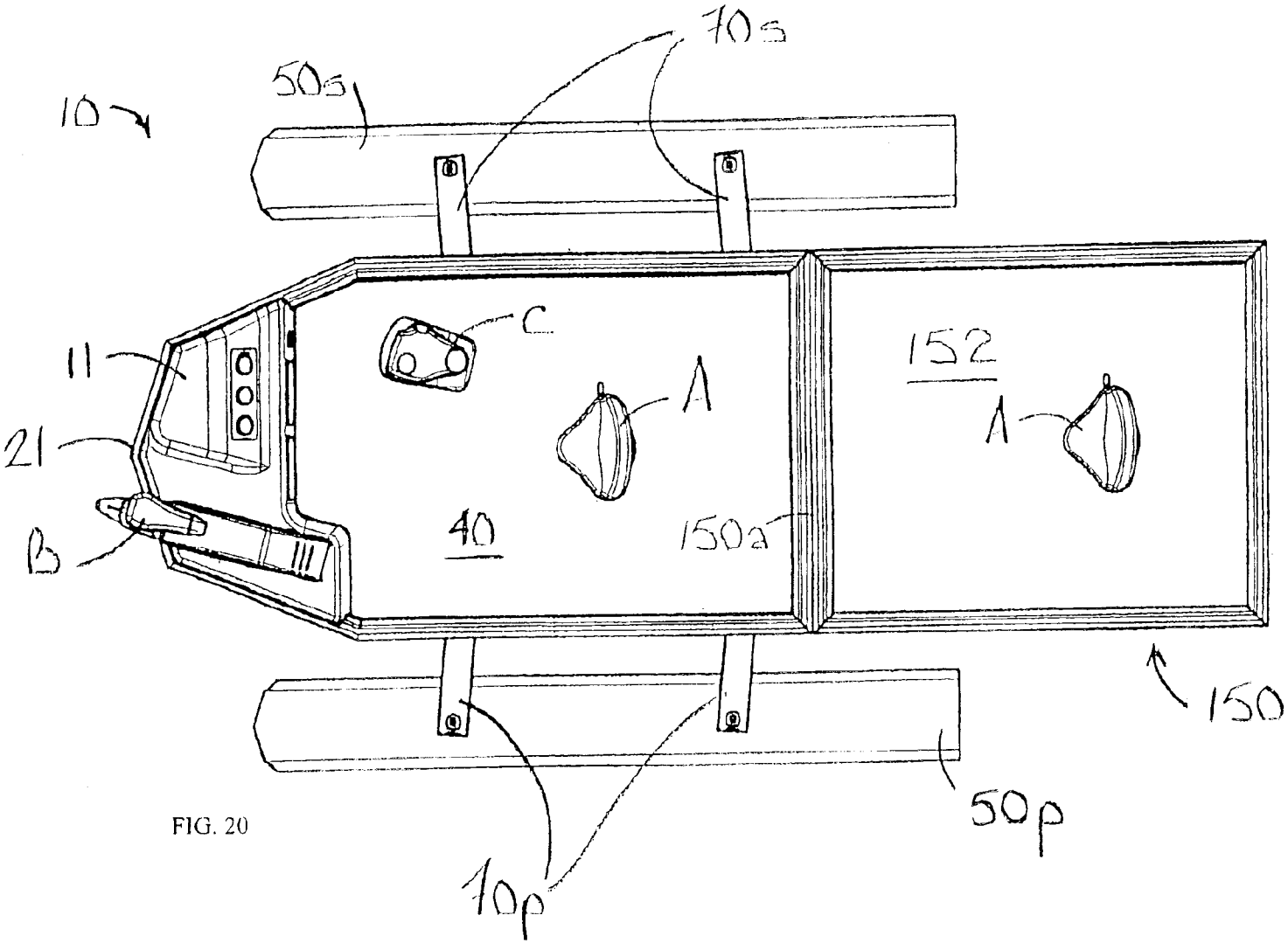
FIG. 20 is a top view of the invention shown in FIG. 19.

Referring generally to FIGS. 19 and 20, one embodiment of a supplemental decking attachment 150 has (i) a pair of elements (not shown) proximate the front 150*a* of the supplemental decking attachment 150 configured and arranged for cooperatively releasably engaging the pair of hitch attachments 92 secured to the hull 20 proximate the stern 22, and (ii) a deck 152 providing at least 5 $ft^2$ of a planar upper surface (unnumbered). The supplemental decking attachment 150 preferably includes at least one of (i) a hull 151, such as shown in FIG. 19, having a bottom (unnumbered) and topsides (unnumbered), and (ii) a laterally centralized bouyancy tank (not shown). The hull 151 and/or bouyancy tank (not shown) should be sized to flotatably support an individual (not shown) on the deck 152 of the supplemental decking attachment 150 when the supplemental decking attachment 150 is attached to a watercraft 10. The supplemental decking attachment 150 also preferably includes a socket 153 for a pedestal seat A.

I claim:

1. A personal watercraft, comprising:

(a) a hull defining a deck with a planar upper surface and having a bow, a stern, a starboard side, a port side, a longitudinally extending overall length and a laterally extending beam, and (b) a plurality of pontoons repositionably attached to the hull with,at least one pontoon attached proximate the starboard side and at least one pontoon attached proximate the port side, (c) wherein the pontoons are laterally and longitudinally repositionable within a single plane relative to the bull as between a storage position in which the pontoons are generally longitudinally aligned relative to the hull and have a minimized lateral distance between the pontoons with at least a portion of the pontoons transversely positioned underneath the deck, and a flotation position in which the pontoons are shifted aft relative to the longitudinally aligned storage position and have a maximized lateral distance between the pontoons.

2. The personal watercraft of claim 1 wherein the deck has at least 16 $ft^2$ of a planar upper surface.

3. The personal watercraft of claim 1 wherein the deck has at least 20 $ft^2$ of a planar upper surface.

4. The personal watercraft of claim 1 wherein the personal watercraft has a maximum lateral width of between 3 feet and 4 feet when the pontoons are in the storage position.

5. The personal watercraft of claim 1 wherein the personal watercraft has a maximum longitudinal length of between 6 feet and 8 feet when the pontoons are in the storage position.

6. The personal watercraft of claim 1 wherein the personal watercraft has a maximum transverse height of between 1 foot and 3 feet when the pontoons are in the storage position.

7. The personal watercraft of claim 1 wherein the starboard side pontoon and the port side pontoon are independently repositionable.

8. The personal watercraft of claim 1 wherein the starboard side pontoon and the port side pontoon are coincidentally repositionable whereby repositioning of one pontoon effects a corresponding repositioning of the other pontoon.

9. The personal watercraft of claim 1 wherein:

(i) the starboard side pontoon is repositionably attached to the hull by at least one starboard side connector link with a proximal end pivotably attached to the hull for pivoting about a transverse pivot axis and a distal end pivotably attached to the starboard side pontoon for pivoting about another transverse pivot axis, (ii) the port side pontoon is repositionably attached to the hull by at least one port side connector link with a proximal end pivotably attached to the hull for pivoting about a transverse pivot axis and a distal end pivotably attached to the port side pontoon for pivoting about another transverse pivot axis.

(iii) the port side pontoon is repositionably attached to the hull by at least one port side connector link with a proximal end pivotably attached to the hull for pivoting about a transverse pivot axis and a distal end pivotably attached to the port side pontoon for pivoting about another transverse pivot axis.

10. The personal watercraft of claim 1 wherein:

(i) the starboard side pontoon is repositionably attached to the hull by at least two longitudinally spaced starboard side connector links with each starboard side connector link having a proximal end pivotably attached to the hull for pivoting about a transverse pivot axis and a distal end pivotably attached to the port side pontoon for pivoting about another transverse pivot axis, and (ii) the port side pontoon is repositionably attached to the hull by at least two longitudinally spaced port side connector links with each port side connector link having a proximal end pivotably attached to the hull for pivoting about a transverse pivot axis and a distal end pivotably attached to the port side pontoon for pivoting about another transverse pivot axis.

11. The personal watercraft of claim 1 further comprising a means for releasably retaining the pontoons at a fixed lateral and longitudinal location when in the storage position, the flotation position and at least one intermediate position between the storage position and the flotation position.

12. A personal watercraft having a length and a width, comprising:

(a) a hull defining a deck with a planar upper surface and having a bow, a stern, a starboard side, a port side, a longitudinally extending overall length and a laterally extending beam, and (b) a plurality of pontoons repositionably attached to the hull with at least one pontoon positioned off a starboard bow of the hull, at least one pontoon positioned off a starboard quarter of the hull, at least one pontoon positioned off a port bow of the hull, and at least one pontoon positioned off a port quarter of the hull, (c) wherein the pontoons are laterally and longitudinally repositionable as between a storage position having a minimized lateral and longitudinal distance between the pontoons to facilitate transportation and storage, and a flotation position having a maximized lateral and longitudinal distance between the pontoons to provide improved flotation stability relative to the storage position.

13. The personal watercraft of claim 12 wherein deck has at least 16 $ft^2$ of a planar upper surface.

14. The personal watercraft of claim 12 wherein the deck has at least 20 $ft^2$ of a planar upper surface.

15. The personal watercraft of claim 12 wherein the personal watercraft has a maximum lateral width of between 3 feet and 4 feet when the pontoons are in the storage position.

16. The personal watercraft of claim 12 wherein the personal watercraft has a maximum longitudinal length of between 6 feet and 8 feet when the pontoons are in the storage position.

17. The personal watercraft of claim 12 wherein the personal watercraft has a maximum transverse height of between 1 foot and 3 feet when the pontoons are in the storage position.

18. The personal watercraft of claim 12 wherein:

(i) the pontoons off the starboard bow and the starboard quarter are coincidentally repositionable whereby repositioning of one pontoon effects a corresponding repositioning of the other pontoon, and (ii) the pontoons off the port bow and the port quarter are coincidentally repositionable whereby repositioning of one pontoon effects a corresponding repositioning of the other pontoon.

19. The personal watercraft of claim 12 wherein the pontoons off the starboard bow, starboard quarter, port bow and port quarter are all coincidentally repositionable whereby repositioning of one pontoon effects a corresponding repositioning of all other pontoons.

20. The personal watercraft of claim 12 wherein:

(i) the pontoon positioned off the starboard bow is repositionably attached to the hull by at least one starboard bow side connector link with a proximal end pivotably attached to the hull for pivoting about a transverse pivot axis and a distal end pivotably attached to the pontoon positioned off the starboard bow for pivoting about another transverse pivot axis, (ii) the pontoon positioned off the starboard quarter is repositionably attached to the hull by at least one starboard quarter side connector link with a proximal end pivotably attached to the hull for pivoting about a transverse pivot axis and a distal end pivotably attached to the pontoon positioned off the starboard quarter for pivoting about another transverse pivot axis, (iii) the pontoon positioned off the port bow is repositionably attached to the hull by at least one port bow side connector link with a proximal end pivotably attached to the hull for pivoting about a transverse pivot axis and a distal end pivotably attached to the pontoon positioned off the port bow for pivoting about another transverse pivot axis, and (iv) the pontoon positioned off the port quarter is repositionably attached to the hull by at least one port quarter side connector link with a proximal end pivotably attached to the hull for pivoting about a transverse pivot axis and a distal end pivotably attached to the pontoon positioned off the port quarter for pivoting about another transverse pivot axis.

21. The personal watercraft of claim 12 wherein:

(i) the pontoon positioned off the starboard bow is repositionably attached to the hull by at least two longitudinally spaced starboard bow connector links with each starboard bow connector link having a proximal end pivotably attached to the hull for pivoting about a transverse pivot axis and a distal end pivotably attached to the pontoon positioned off the starboard bow for pivoting about another transverse pivot axis, (ii) the pontoon positioned off the starboard quarter is repositionably attached to the hull by at least two longitudinally spaced starboard quarter connector links with each starboard quarter connector link having a proximal end pivotably attached to the hull for pivoting about a transverse pivot axis and a distal end pivotably attached to the pontoon positioned off the starboard quarter for pivoting about another transverse pivot axis, (iii) the pontoon positioned off the port bow is repositionably attached to the hull by at least two longitudinally spaced port bow connector links with each port bow connector link having a proximal end pivotably attached to the hull for pivoting about a transverse pivot axis and a distal end pivotably attached to the pontoon positioned off the port bow for pivoting about another transverse pivot axis, and (iv) the pontoon positioned off the port quarter is repositionably attached to the hull by at least two longitudinally spaced port quarter connector links with each port quarter connector link having a proximal end pivotably attached to the hull for pivoting about a transverse pivot axis and a distal end pivotably attached to the pontoon positioned off the port quarter for pivoting about another transverse pivot axis.

22. The personal watercraft of claim 12 further comprising a means for releasably retaining the pontoons at a fixed lateral and longitudinal location when in the storage position, the flotation position and at least one intermediate position between the storage position and the flotation position.

23. A personal watercraft, comprising:

(a) a hull defining a deck with a planar upper surface and having a bow, a stern, a starboard side, a port side, a longitudinally extending overall length and a laterally extending beam, and (b) a pair of laterally spaced hitch attachments secured to the hull below the planar upper surface proximate the stern.

24. The personal watercraft of claim 23 further comprising a pair of laterally spaced hitch attachments secured to the hull below the planar upper surface proximate the bow.

25. The personal watercraft of claim 24 in combination with a towing attachment having (i) a pair of elements proximate a proximal longitudinal end of the towing attachment configured and arranged for cooperatively releasably engaging the pair of hitch attachments secured to the hull proximate the bow, and (ii) a hitch attachment proximate a distal longitudinal end of the towing attachment.

26. The personal watercraft of claim 23 in combination with a wheeled attachment wherein (i) the hull has a bottom, and (ii) the wheeled attachment has (A) at least one element configured and arranged for cooperatively releasably engaging a hitch attachment secured to the hull proximate the stern, and (B) at least one wheel configured and arranged on the wheeled attachment such that the wheel transversely extends below the bottom of the hull when the element on the wheeled attachment is engaged with at least one of the hitch attachments secured to the hull proximate the stern.

27. The personal watercraft of claim 24 in combination with a wheeled attachment wherein (i) the hull has a bottom, and (ii) the wheeled attachment has (A) at least one element configured and arranged for cooperatively releasably engaging a hitch attachment secured to the hull proximate the stern, and (B) at least one wheel configured and arranged on the wheeled attachment such that the wheel transversely extends below the bottom of the hull when the element on the wheeled attachment is engaged with at least one of the hitch attachments secured to the hull proximate the stern.

28. The personal watercraft of claim 23 in combination with a transom attachment having (i) a pair of elements proximate a proximal longitudinal end of the transom attachment configured and arranged for cooperatively releasably engaging the pair of hitch attachments secured to the hull proximate the stern, and (ii) a laterally extending beam proximate a distal longitudinal end of the transom attachment configured and arranged for supporting a boat motor in an operable position.

29. The personal watercraft of claim 24 in combination with a transom attachment having (i) a pair of elements proximate a proximal longitudinal end of the transom attachment configured and arranged for cooperatively releasably engaging the pair of hitch attachments secured to the hull proximate the stern, and (ii) a laterally extending beam proximate a distal longitudinal end of the transom attachment configured and arranged for supporting a boat motor in an operable position.

30. The personal watercraft of claim 23 in combination with an interconnect linkage having (i) a first element proximate a first longitudinal end of the interconnect linkage configured and arranged for cooperatively releasably engaging one of the hitch attachment secured to the hull proximate the stern, and (ii) a second element proximate a second longitudinal end of the interconnect linkage configured and arranged for cooperatively releasably engaging one of the hitch attachments secured to the hull proximate the stern, (iii) whereby the personal watercraft can be interconnected stern-to-stern with a second personal watercraft of claim 26.

31. The personal watercraft of claim 24 in combination with an interconnect linkage having (i) a first element proximate a first longitudinal end of the interconnect linkage configured and arranged for cooperatively releasably engaging one of the hitch attachments secured to the hull proximate the stern, and (ii) a second element proximate a second longitudinal end of the interconnect linkage configured and arranged for cooperatively releasably engaging one of the hitch attachments secured to the bull proximate the stern, (iii) whereby the personal watercraft can be interconnected stern-to-stern with a second personal watercraft of claim 27.

32. The personal watercraft of claim 23 in combination with a supplemental decking attachment having (i) a pair of hitch attachments proximate a first longitudinal end of the supplemental decking attachment configured and arranged for cooperatively releasably engaging the pair of hitch attachments secured to the hull proximate the stern, and (ii) a deck providing at least 5 $ft^2$ of a planar upper surface.

33. The personal watercraft of claim 32 wherein the supplemental decking attachment further includes at least one of (i) a hull having a bottom and topsides, and (ii) a laterally centralized buoyancy tank.

* * * * *

UNITED STATES PATENT AND TRADEMARK OFFICE

CERTIFICATE OF CORRECTION

PATENT NO. : 6,988,456 B1
APPLICATION NO. : 10/765007
DATED : January 24, 2006
INVENTOR(S) : Schooler It is certified that error appears in the above-identified patent and that said Letters Patent is hereby corrected as shown below:

Column 9 Line 39 "bull" should be replaced with "hull"

Column 14 Line 15 "bull" should be replaced with "hull"

Signed and Sealed this

Twenty-ninth Day of January, 2008

JON W. DUDAS
*Director of the United States Patent and Trademark Office*